US008821319B2

(12) United States Patent
Kim

(10) Patent No.: US 8,821,319 B2
(45) Date of Patent: Sep. 2, 2014

(54) DESIGNING METHOD FOR DIMPLE PATTERN OF GOLF BALL

(75) Inventor: Hyoungchol Kim, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 557 days.

(21) Appl. No.: 13/101,244

(22) Filed: May 5, 2011

(65) Prior Publication Data

US 2012/0004053 A1 Jan. 5, 2012

(30) Foreign Application Priority Data

Jun. 30, 2010 (JP) ..... 2010-148473

(51) Int. Cl.
*A63B 37/12* (2006.01)
*A63B 37/00* (2006.01)

(52) U.S. Cl.
CPC ..... *A63B 37/0006* (2013.01)
USPC ..... 473/381; 473/409; 473/379; 473/378

(58) Field of Classification Search
USPC ..... 473/381, 379
See application file for complete search history.

(56) References Cited

U.S. PATENT DOCUMENTS

| | | | | | |
|---|---|---|---|---|---|
| 4,142,727 | A | * | 3/1979 | Shaw et al. | 473/381 |
| 4,560,168 | A | * | 12/1985 | Aoyama | 473/379 |
| 4,722,529 | A | * | 2/1988 | Shaw et al. | 473/381 |
| 4,744,564 | A | | 5/1988 | Yamada | |
| 4,813,677 | A | * | 3/1989 | Oka et al. | 473/384 |
| 4,877,252 | A | * | 10/1989 | Shaw | 473/379 |
| 4,960,282 | A | * | 10/1990 | Shaw | 473/379 |
| 5,046,742 | A | * | 9/1991 | Mackey | 473/383 |
| 5,078,402 | A | * | 1/1992 | Oka | 473/380 |
| 5,092,604 | A | * | 3/1992 | Oka | 473/380 |
| 5,377,989 | A | * | 1/1995 | Machin | 473/379 |
| 5,503,398 | A | * | 4/1996 | Lu | 473/384 |
| 5,688,194 | A | | 11/1997 | Stiefel et al. | |
| 5,772,532 | A | | 6/1998 | Stiefel et al. | |
| 5,997,418 | A | | 12/1999 | Tavares et al. | |
| 6,066,055 | A | | 5/2000 | Nishino | |
| 6,234,917 | B1 | | 5/2001 | Asakura | |
| 6,254,496 | B1 | | 7/2001 | Maehara et al. | |
| 6,409,615 | B1 | * | 6/2002 | McGuire et al. | 473/383 |
| 6,435,988 | B2 | * | 8/2002 | Maehara et al. | 473/378 |
| 6,702,696 | B1 | * | 3/2004 | Nardacci | 473/383 |
| 6,884,184 | B2 | * | 4/2005 | Nardacci | 473/383 |

(Continued)

FOREIGN PATENT DOCUMENTS

| | | | |
|---|---|---|---|
| JP | 61-284264 | A | 12/1986 |
| JP | 9-164223 | A | 6/1997 |

(Continued)

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

A designing method according to the present invention includes the steps of:

(1) dividing a surface of a phantom sphere of a golf ball 2 into a plurality of units U by division lines 14 obtained by projecting edge lines of a regular polyhedron inscribed in the phantom sphere, on the surface of the phantom sphere;

(2) obtaining a base pattern by randomly arranging a plurality of dimples 8 in one unit U such that the dimples 8 do not overlap each other; and (3) developing the base pattern over other units U such that patterns of two adjacent units U are not mirror-symmetrical to each other. The regular polyhedron is preferably a regular dodecahedron or a regular icosahedrons.

5 Claims, 41 Drawing Sheets

(56) References Cited

U.S. PATENT DOCUMENTS

| | | | | |
|---|---|---|---|---|
| 7,303,491 | B2 * | 12/2007 | Nardacci et al. | 473/378 |
| 7,473,194 | B2 * | 1/2009 | Nardacci | 473/383 |
| 2004/0171438 | A1 * | 9/2004 | Nardacci | 473/378 |
| 2005/0176525 | A1 * | 8/2005 | Nardacci | 473/378 |
| 2007/0026971 | A1 | 2/2007 | Aoyama et al. | |
| 2008/0043029 | A1 * | 2/2008 | Nardacci et al. | 345/552 |
| 2009/0112345 | A1 * | 4/2009 | Nardacci | 700/103 |
| 2009/0191982 | A1 | 7/2009 | Kim et al. | |

FOREIGN PATENT DOCUMENTS

| | | | |
|---|---|---|---|
| JP | 11-137721 | A | 5/1999 |
| JP | 2000-93556 | A | 4/2000 |
| JP | 2000-189542 | A | 7/2000 |
| JP | 2002-529164 | A | 9/2002 |
| JP | 2004-167088 | A | 6/2004 |
| JP | 2006-212437 | A | 8/2006 |
| JP | 2007-29744 | A | 2/2007 |
| JP | 2009-172192 | A | 8/2009 |

* cited by examiner

DESIGNING METHOD FOR DIMPLE PATTERN OF GOLF BALL

This application claims priority on Patent Application No. 2010-148473 filed in JAPAN on Jun. 30, 2010. The entire contents of this Japanese Patent Application are hereby incorporated by reference.

BACKGROUND OF THE INVENTION

1. Field of the Invention

The present invention relates to golf balls. Specifically, the present invention relates to designing methods for dimple patterns of golf balls.

2. Description of the Related Art

Golf balls have a large number of dimples on the surface thereof. The dimples disturb the air flow around the golf ball during flight to cause turbulent flow separation. By causing the turbulent flow separation, separation points of the air from the golf ball shift backwards leading to a reduction of drag. The turbulent flow separation promotes the displacement between the separation point on the upper side and the separation point on the lower side of the golfball, which results from the backspin, thereby enhancing the lift force that acts upon the golf ball. The reduction of drag and the enhancement of lift force are referred to as a "dimple effect".

Generally, a golf ball is formed by a mold having upper and lower mold halves. Since a molding material (e.g. a synthetic resin) leaks out from the parting face between the upper and lower mold halves, a flash is generated along the equator portion on the surface of the golf ball. The flash is generated along the parting line. The flash is ground and removed with a whetstone or the like. Removal of a flash generated inside the dimple is difficult. In order to facilitate the removal of the flash, no dimple is formed on the equator. In other words, no dimple is provided on the parting face of the mold. A great circle path is formed on the seam of a golf ball obtained by using this mold. The great circle path agrees with the equator. When a flash is removed, the land near the equator may be removed together with the flash. Due to this removal, dimples are deformed. In addition, the dimples near the equator tend to be orderly arranged.

Thus, the equator has the following characteristics:

(1) a great circle path exists;

(2) the dimples near the equator may be deformed; and (3) the dimples near the equator tend to be orderly arranged.

On the surface of the golf ball, the region near the equator is a unique region.

Rotation in which the rotational axis of backspin passes through both poles is referred to as PH rotation. Meanwhile, rotation of which the rotational axis is orthogonal to the rotational axis of PH rotation is referred to as POP rotation. As described above, the region near the equator is a unique region. During PH rotation, a part where the greatest circumferential speed of the backspin is attained agrees with the equator. Thus, a sufficient dimple effect is not obtained. The dimple effect during PH rotation is less than the dimple effect during POP rotation. The difference between these dimple effects impairs the aerodynamic symmetry of a golf ball. Other than a shot at a teeing ground, golf players cannot decide a hitting place of a golf ball. Thus, the flight distance of a golf ball with inferior aerodynamic symmetry is variable. Golf players have difficulty in landing this golf ball at an intended point.

The United States Golf Association (USGA) has established the rules about aerodynamic symmetries of golf balls.

A golf ball having a large difference between the trajectory during PH rotation and the trajectory during POP rotation does not conform to the rules. The golf ball cannot be used in golf tournaments.

JP-S61-284264 discloses a golf ball in which the dimples near the seam are greater in volume than the dimples near the poles. This volume difference contributes to eliminating the aerodynamic asymmetry caused by the uniqueness of the region near the equator. A similar golf ball is also disclosed in JP2000-93556.

JP-H9-164223 discloses a method in which a large number of dimples are randomly arranged by a computer. A golf ball having randomly arranged dimples has excellent aerodynamic symmetry. A similar method is also disclosed in JP2000-189542.

The golf ball disclosed in JP-S61-284264 eliminates, by the volume difference of dimples, the disadvantage caused by the dimple pattern. The disadvantage caused by the dimple pattern is eliminated not by modification of the dimple pattern. In the golf ball, the potential of the dimple pattern is sacrificed. The flight distance of the golf ball is insufficient. Similarly, the flight distance of the golf ball disclosed in JP2000-93556 is also insufficient.

In the method disclosed in JP-H9-164223, trials and errors are required for deciding a pattern, and it takes a long period of time for this decision. In this method, since the pattern depends on the computer, an intention of a designer is unlikely to be reflected in the pattern. In addition, the pattern obtained by this method has a wide variety of dimples. Thus, time and labor are required for producing a mold. The method disclosed in JP2000-189542 also has similar problems.

An object of the present invention is to provide a designing method by which a pattern having excellent aerodynamic symmetry can be easily obtained.

SUMMARY OF THE INVENTION

A designing method for a dimple pattern of a golf ball according to the present invention includes the steps of:

(1) dividing a surface of a phantom sphere of the golf ball into a plurality of units by division lines obtained by projecting edge lines of a regular polyhedron inscribed in the phantom sphere, on the surface of the phantom sphere;

(2) obtaining a base pattern by randomly arranging a plurality of dimples in one unit such that the dimples do not overlap each other; and (3) developing the base pattern over other units such that patterns of two adjacent units are not mirror-symmetrical to each other. By the method, a dimple pattern can be easily designed. A golf ball having the dimple pattern has excellent aerodynamic symmetry.

Preferably, the designing method further comprises the step of (4-1) correcting a position of a dimple in the vicinity of a boundary between two adjacent units such that a distance between two adjacent dimples is reduced.

Preferably, the designing method further comprises the step of (4-2) correcting a position of a dimple in the vicinity of a boundary between two adjacent units such that three or more dimples are not arranged along a line.

Preferably, the regular polyhedron is a regular dodecahedron, and each unit is a spherical regular pentagon. The spherical regular pentagon is obtained by dividing the surface of the phantom sphere by division lines obtained by projecting edge lines of the regular dodecahedron on the surface of the phantom sphere.

The regular polyhedron may be a regular icosahedron, and each unit may be a pair of two adjacent spherical regular triangles. Each spherical regular triangle is obtained by dividing the surface of the phantom sphere by division lines obtained by projecting edge lines of the regular icosahedron on the surface of the phantom sphere.

In a golf ball having a dimple pattern designed by the method according to the present invention, a ratio of a total area of all dimples to a surface area of a phantom sphere of the golf ball is preferably equal to or greater than 75% but equal to or less than 85%. Preferably, the golf ball does not have any great circle that does not intersect any dimple.

DESCRIPTION OF THE PREFERRED EMBODIMENTS

Hereinafter, the present invention will be described in detail based on preferred embodiments with reference to the accompanying drawings.

Embodiment 1

Figure 1:
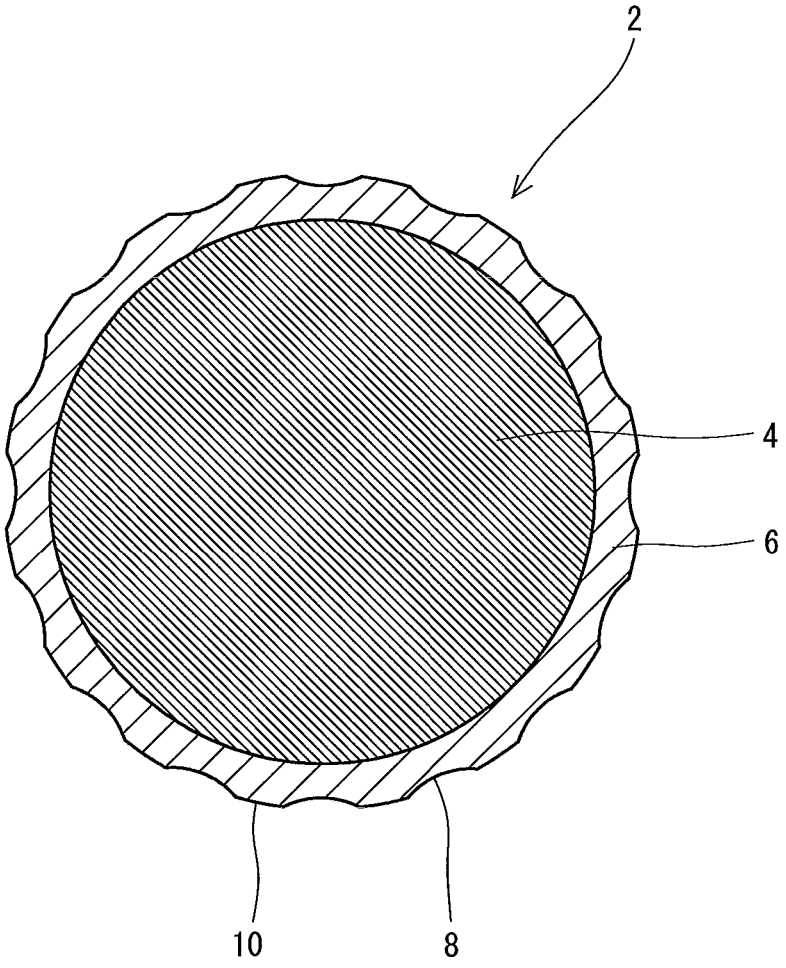
FIG. 1 is a schematic cross-sectional view of a golf ball according to an embodiment of the present invention.

A golf ball 2 shown in FIG. 1 includes a spherical core 4 and a cover 6. On the surface of the cover 6, a large number of dimples 8 are formed. Of the surface of the golf ball 2, a part other than the dimples 8 is a land 10. The golf ball 2 includes a paint layer and a mark layer on the external side of the cover 6 although these layers are not shown in the drawing. A mid layer may be provided between the core 4 and the cover 6.

The golf ball 2 has a diameter of 40 mm or greater but 45 mm or less. From the standpoint of conformity to the rules established by the United States Golf Association (USGA), the diameter is more preferably equal to or greater than 42.67 mm. In light of suppression of air resistance, the diameter is more preferably equal to or less than 44 mm and particularly preferably equal to or less than 42.80 mm. The golf ball 2 has a weight of 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is more preferably equal to or less than 45.93 g.

The core 4 is formed by crosslinking a rubber composition. Examples of base rubbers for use in the rubber composition include polybutadienes, polyisoprenes, styrene-butadiene copolymers, ethylene-propylene-diene copolymers and natural rubbers. Two or more of these rubbers may be used in combination. In light of resilience performance, polybutadienes are preferred, and in particular, high-cis polybutadienes are preferred.

In order to crosslink the core 4, a co-crosslinking agent can be used. Examples of preferable co-crosslinking agents in light of resilience performance include zinc acrylate, magnesium acrylate, zinc methacrylate and magnesium methacrylate. The rubber composition includes an organic peroxide together with a co-crosslinking agent. Examples of suitable organic peroxides include dicumyl peroxide, 1,1-bis(t-butylperoxy)-3,3,5-trimethylcyclohexane, 2,5-dimethyl-2,5-di(t-butylperoxy)hexane and di-t-butyl peroxide.

According to need, various additives such as a sulfur compound, a filler, an anti-aging agent, a coloring agent, a plasticizer, a dispersant and the like are included in the rubber composition of the core 4 in an adequate amount. Crosslinked rubber powder or synthetic resin powder may be also included in the rubber composition.

The diameter of the core 4 is equal to or greater than 30.0 mm and particularly equal to or greater than 38.0 mm. The diameter of the core 4 is equal to or less than 42.0 mm and particularly equal to or less than 41.5 mm. The core 4 may be formed with two or more layers.

A suitable polymer for the cover 6 is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion and neodymium ion.

Other polymers may be used instead of or together with an ionomer resin. Examples of the other polymers include thermoplastic polyurethane elastomers, styrene block-containing thermoplastic elastomers, thermoplastic polyamide elastomers, thermoplastic polyester elastomers and thermoplastic polyolefin elastomers.

According to need, a coloring agent such as titanium dioxide, a filler such as barium sulfate, a dispersant, an antioxidant, an ultraviolet absorber, a light stabilizer, a fluorescent material, a fluorescent brightener and the like are included in the cover 6 at an adequate amount. For the purpose of adjusting specific gravity, powder of a metal with a high specific gravity such as tungsten, molybdenum and the like may be included in the cover 6.

The thickness of the cover 6 is equal to or greater than 0.3 mm and particularly equal to or greater than 0.5 mm. The thickness of the cover 6 is equal to or less than 2.5 mm and particularly equal to or less than 2.2 mm. The specific gravity of the cover 6 is equal to or greater than 0.90 and particularly equal to or greater than 0.95. The specific gravity of the cover 6 is equal to or less than 1.10 and particularly equal to or less than 1.05. The cover 6 may be formed with two or more layers.

Figure 2:
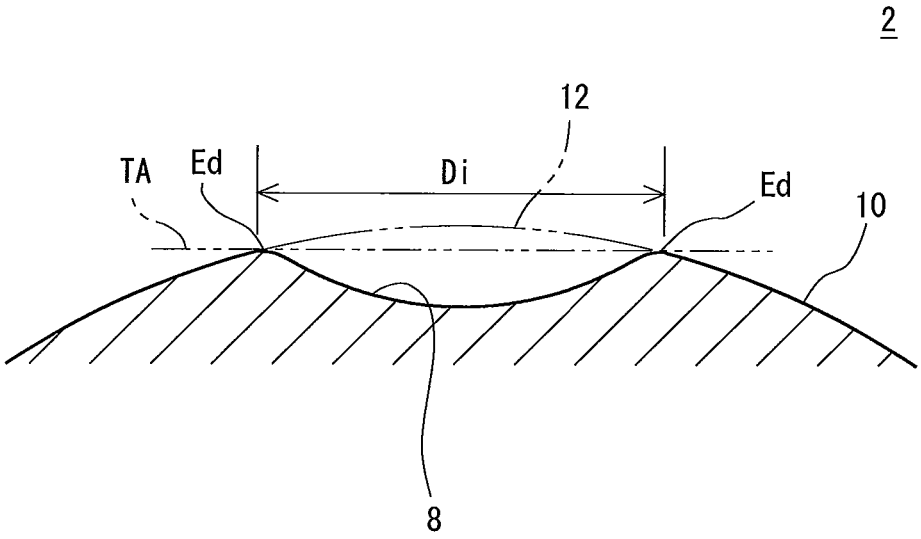
FIG. 2 is a partially enlarged cross-sectional view of the golf ball in FIG. 1.

FIG. 2 is a partially enlarged cross-sectional view of the golf ball 2 in FIG. 1. FIG. 2 shows a cross section along a plane passing through the center (deepest part) of the dimple 8 and the center of the golf ball 2. In FIG. 2, the top-to-bottom direction is the depth direction of the dimple 8. In FIG. 2, what is indicated by a chain double-dashed line is the surface of a phantom sphere 12. The surface of the phantom sphere 12 is the surface of the golf ball 2 when it is postulated that no dimple 8 exists. The dimple 8 is recessed from the surface of the phantom sphere 12. The land 10 agrees with the surface of the phantom sphere 12.

In FIG. 2, what is indicated by a double ended arrow Di is the diameter of the dimple 8. The diameter Di is the distance between two tangent points Ed appearing on a tangent line TA that is drawn tangent to the far opposite ends of the dimple 8. Each tangent point Ed is also the edge of the dimple 8. The edge Ed defines the contour of the dimple 8. The diameter Di is preferably equal to or greater than 2.00 mm but equal to or less than 6.00 mm. By setting the diameter Di to be 2.00 mm or greater, a superior dimple effect is achieved. In this respect, the diameter Di is more preferably equal to or greater than 2.20 mm and particularly preferably equal to or greater than 2.40 mm. By setting the diameter Di to be 6.00 mm or less, a fundamental feature of the golf ball 2 being substantially a sphere is not impaired. In this respect, the diameter Di is more preferably equal to or less than 5.80 mm and particularly preferably equal to or less than 5.60 mm.

Figure 3:
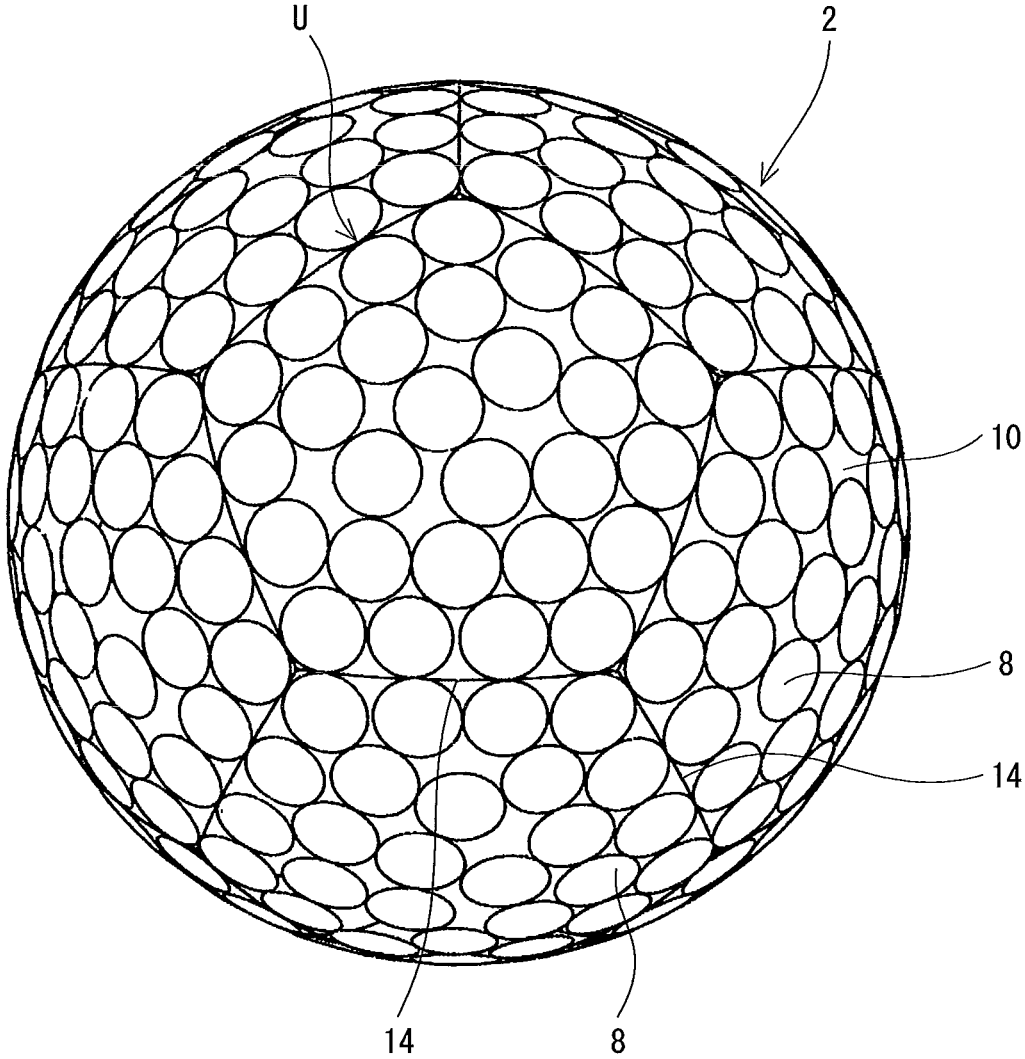
FIG. 3 is an enlarged front view of the golf ball in FIG. 1.
Figure 4:
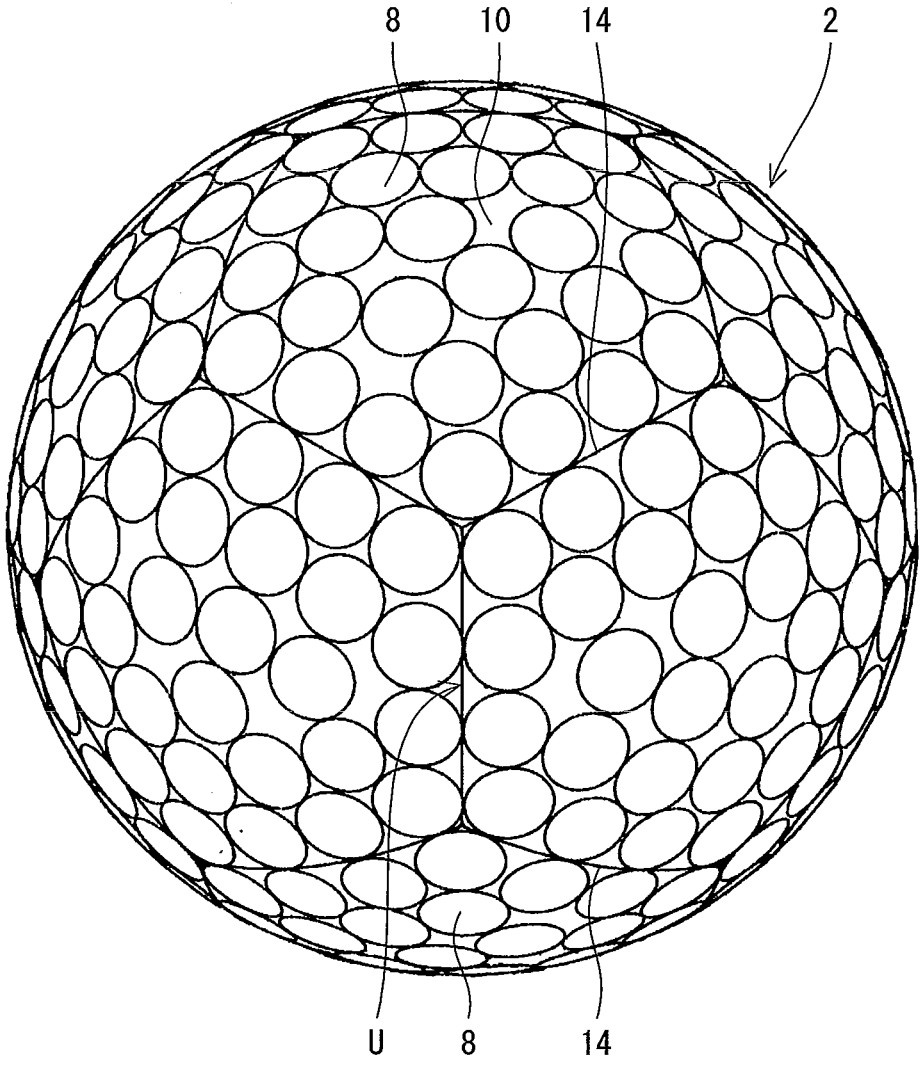
FIG. 4 is a plan view of the golf ball in FIG. 3.

FIG. 3 is an enlarged front view of the golf ball 2 in FIG. 1. FIG. 4 is a plan view of the golf ball 2 in FIG. 3. FIGS. 3 and 4 show division lines 14 obtained by projecting the edge lines of the regular dodecahedron inscribed in the phantom sphere 12, on the surface of the phantom sphere 12. In the actual golf ball 2, the division lines 14 are not viewed.

By these division lines 14, the surface of the phantom sphere 12 is divided into 12 units U. Each unit U is a spherical regular pentagon. In the present specification, the spherical regular pentagon is a curved surface existing on the surface of the phantom sphere 12. The edges of the spherical regular pentagon are five circular arcs.

Figure 5:
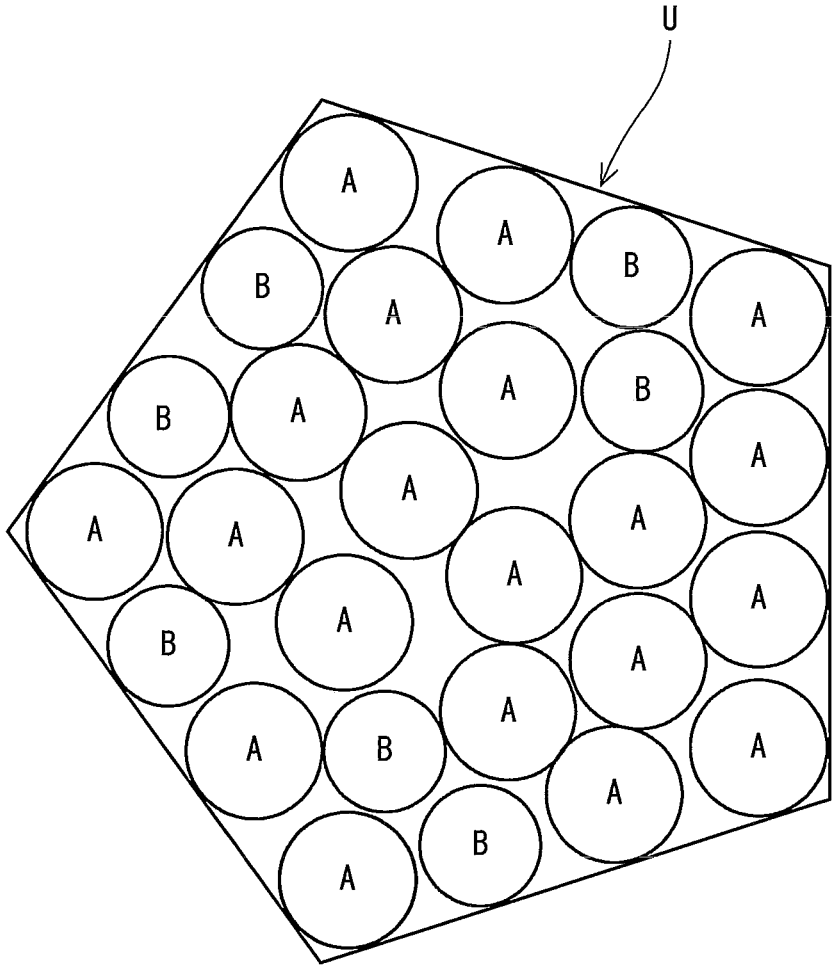
FIG. 5 is a schematic view of a base pattern of the golf ball in FIG. 3.

In a designing method according to the present invention, a base pattern is designed in one unit U. FIG. 5 shows the base pattern. In FIG. 5, for convenience's sake, the unit U is drawn as a regular pentagon, not as a spherical regular pentagon. In designing the base pattern, a plurality of dimples 8 is randomly arranged in the unit U such that the dimples 8 do not overlap each other. The unit U has dimples A each having a diameter of 4.30 mm and dimples B each having a diameter of 4.10 mm. The number of the dimples A is 20. The number of the dimples B is 7. The diameter and the number of the types of the dimples 8 are decided arbitrarily by a designer.

Since the dimples 8 are randomly arranged, the base pattern does not have line symmetry in a plan view. In other words, the pattern does not have an axis of line symmetry. Since the dimples 8 are randomly arranged, the base pattern does not have rotational symmetry. The rotational symmetry means a state where when the pattern is rotated about the center of gravity of the unit U by a rotation angle less than 360°, the pattern overlaps the pattern before the rotation.

Figure 6:
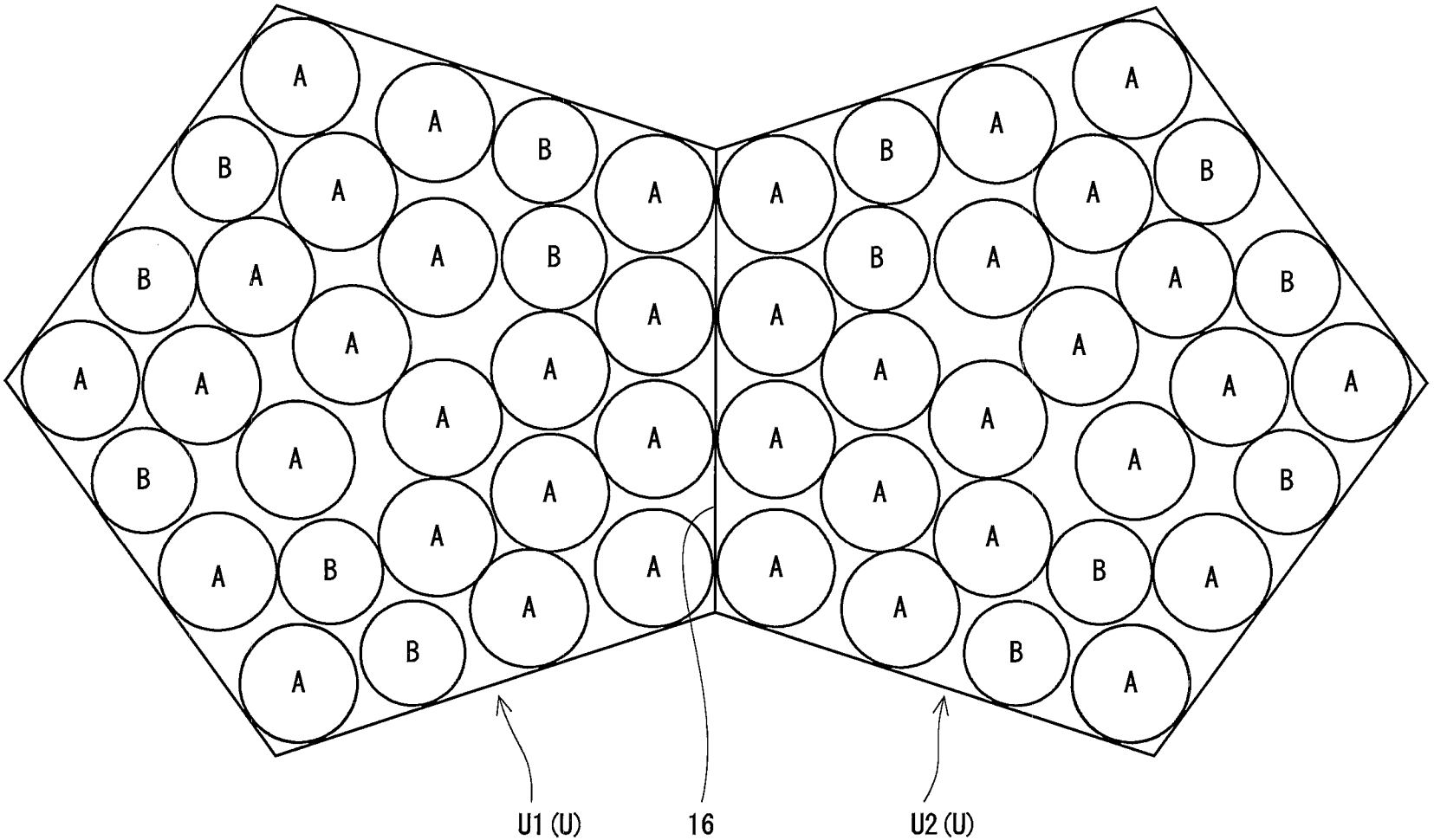
FIG. 6 is a schematic view of a pattern in which the base pattern in FIG. 5 is developed.

The base pattern is developed over the other units U. When developed, the base pattern may be transferred to the other units U without changing the base pattern. When developed, a pattern obtained by mirror-inverting the base pattern may be transferred to the other units U. The pattern obtained by mirror-inverting the base pattern is mirror-symmetrical to the base pattern. Even in the pattern obtained by mirror-inverting the base pattern, the dimples 8 are randomly arranged. In FIG. 6, a pattern that is mirror-symmetrical to the pattern (base pattern) of a first unit U1 is transferred to a second unit U2. The pattern of the first unit U1 and the pattern of the second unit U2 are mirror-symmetrical to each other with respect to the plane passing through a boundary line 16 and the center of the golf ball 2.

Figure 7:
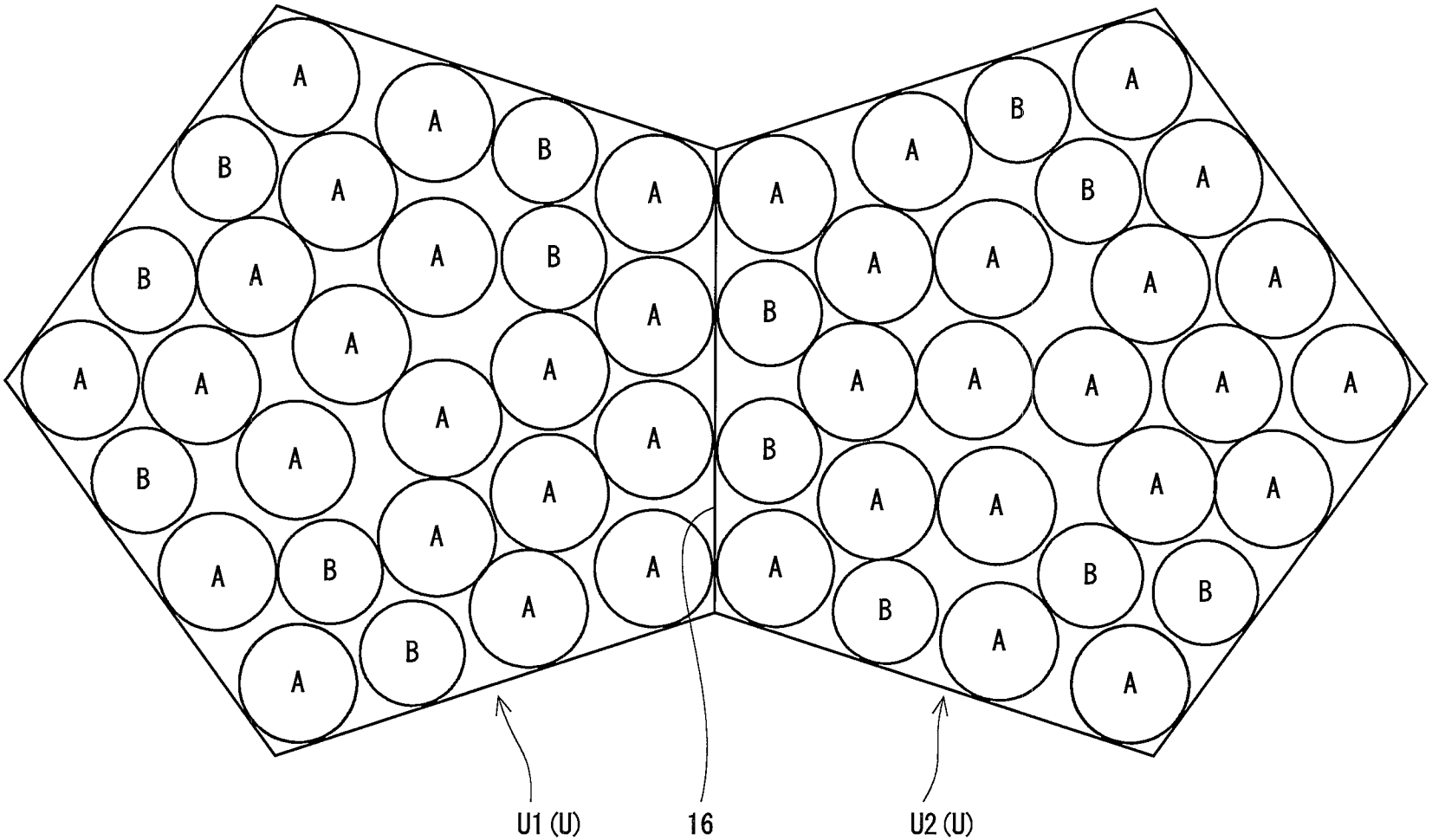
FIG. 7 is a schematic view of a pattern obtained by correcting the pattern in FIG. 6.

In light of aerodynamic symmetry of the golf ball 2, it is not preferred if the patterns of adjacent units U are mirror-symmetrical to each other. When the patterns of adjacent units U are mirror-symmetrical to each other, correction is performed for either one of the units U. FIG. 7 shows a pattern after the correction. The pattern in FIG. 7 is obtained by rotating the pattern of the second unit U2 shown in FIG. 6 about the center of gravity of the second unit U2 by 144°. In FIG. 7, the pattern of the first unit U1 and the pattern of the second unit U2 are not mirror-symmetrical to each other with respect to the plane passing through the boundary line 16.

Such development is also performed on the other units U. A pattern obtained by repeating the mirror inversion two or more times may be transferred to the other units U. As a result of completion of the transfer to all the units U, a pattern having 240 dimples A and 84 dimples B is obtained.

The dimples 8 are randomly arranged in each unit U, and the pattern of one unit U and the pattern of another unit U are not mirror-symmetrical to each other. Thus, the golf ball 2 has excellent aerodynamic symmetry. In the designing method, a pattern having excellent aerodynamic symmetry can be obtained easily in a short time. In the designing method, the designer decides the diameter and the number of the types of the dimples 8. Thus, a dimple pattern in which an intention of the designer is reflected can be obtained.

In the golf ball 2, the number of pairs of adjacent units is 30. Ideally, a state where the pattern of one unit U and the pattern of the other unit U are not mirror-symmetrical to each other is achieved in all the pairs of the adjacent units. In some of the pairs of the adjacent units, the pattern of one unit U and the pattern of the other unit U may be mirror-symmetrical to each other. In light of aerodynamic symmetry of the golf ball 2, the ratio Pn of the number of pairs of adjacent units that are not mirror-symmetrical to each other, to the total number of the pairs of the adjacent units is preferably equal to or greater than 50%, more preferably equal to or greater than 65%, and particularly preferably equal to or greater than 80%. In the dimple pattern shown in FIGS. 3 and 4, the ratio Pn is 96.7%.

The number of the units U in one golf ball 2 is preferably equal to or greater than 8 and more preferably equal to or greater than 10. The number of the units U is preferably equal to or less than 12.

The area S of the dimple 8 is the area of a region surrounded by the contour line when the center of the golf ball 2 is viewed at infinity. In the case of a circular dimple 8, the area S is calculated by the following mathematical formula.

$$S=(Di/2)^2*\pi$$

In the golf ball 2 shown in FIGS. 3 and 4, the area of the dimple A is 14.52 $mm^2$, and the area of the dimple B is 13.20 $mm^2$.

In the present invention, the ratio of the sum of the areas S of all the dimples 8 to the surface area of the phantom sphere 12 is referred to as an occupation ratio. From the standpoint that a sufficient dimple effect is achieved, the occupation ratio is preferably equal to or greater than 75%, more preferably equal to or greater than 78%, and particularly preferably equal to or greater than 80%. The occupation ratio is preferably equal to or less than 85%. In the golf ball 2 shown in FIGS. 3 and 4, the total area of all the dimples 8 is 4594 $mm^2$. The surface area of the phantom sphere 12 of the golf ball 2 is 5728 $mm^2$, and thus the occupation ratio is 80%.

In light of suppression of rising of the golf ball 2 during flight, the depth of the dimple 8 is preferably equal to or greater than 0.05 mm, more preferably equal to or greater than 0.08 mm, and particularly preferably equal to or greater than 0.10 mm. In light of suppression of dropping of the golf ball 2 during flight, the depth of the dimple 8 is preferably equal to or less than 0.60 mm, more preferably equal to or less than 0.45 mm, and particularly preferably equal to or less than 0.40 mm. The depth is the distance between the tangent line TA and the deepest part of the dimple 8.

In the present invention, the term "dimple volume" means the volume of a part surrounded by the surface of the dimple 8 and a plane that includes the contour of the dimple 8. In light of suppression of rising of the golf ball 2 during flight, the sum of the volumes (total volume) of all the dimples 8 is preferably equal to or greater than 240 $mm^3$, more preferably equal to or greater than 260 $mm^3$, and particularly preferably equal to or greater than 280 $mm^3$. In light of suppression of dropping of the golf ball 2 during flight, the total volume is preferably equal to or less than 400 $mm^3$, more preferably equal to or less than 380 $mm^3$, and particularly preferably equal to or less than 360 $mm^3$.

From the standpoint that a sufficient occupation ratio can be achieved, the total number of the dimples 8 is preferably equal to or greater than 200, more preferably equal to or greater than 250, and particularly preferably equal to or greater than 300. From the standpoint that the individual dimples 8 can have a sufficient diameter, the total number is preferably equal to or less than 500, more preferably equal to or less than 450, and particularly preferably equal to or less than 400.

The golf ball 2 does not have any great circle that does not intersect any dimple 8. The golf ball 2 does not have any great circle path. The golf ball 2 has excellent aerodynamic symmetry.

Figure 8:
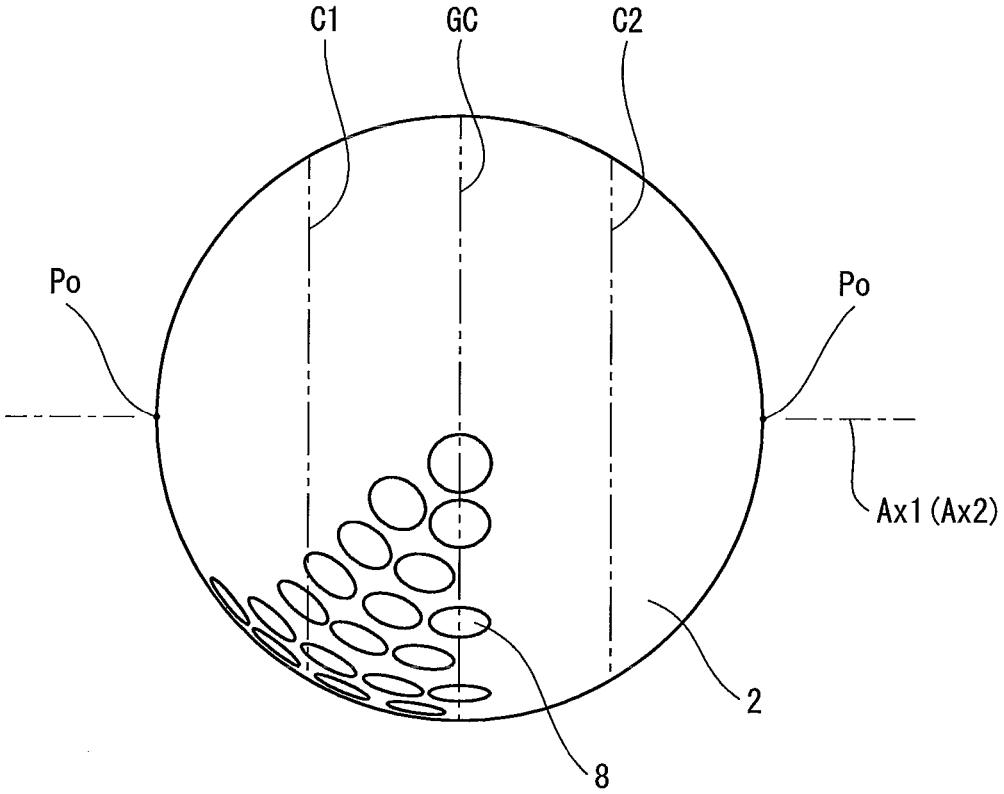
FIG. 8 is a schematic view for explaining a method for evaluating the golf ball in FIG. 1.

Hereinafter, an evaluation method for the aerodynamic characteristic of the golf ball 2 will be described. FIG. 8 is a schematic view for explaining the evaluation method. In the evaluation method, a first rotation axis Ax1 is assumed. The first rotation axis Ax1 passes through the two poles Po of the golf ball 2. Each pole Po corresponds to the deepest part of the mold used for forming the golf ball 2. One of the poles Po corresponds to the deepest part of an upper mold half, and the other pole Po corresponds to the deepest part of a lower mold half. The golf ball 2 rotates about the first rotation axis Ax1. This rotation is referred to as PH rotation.

Figure 9:
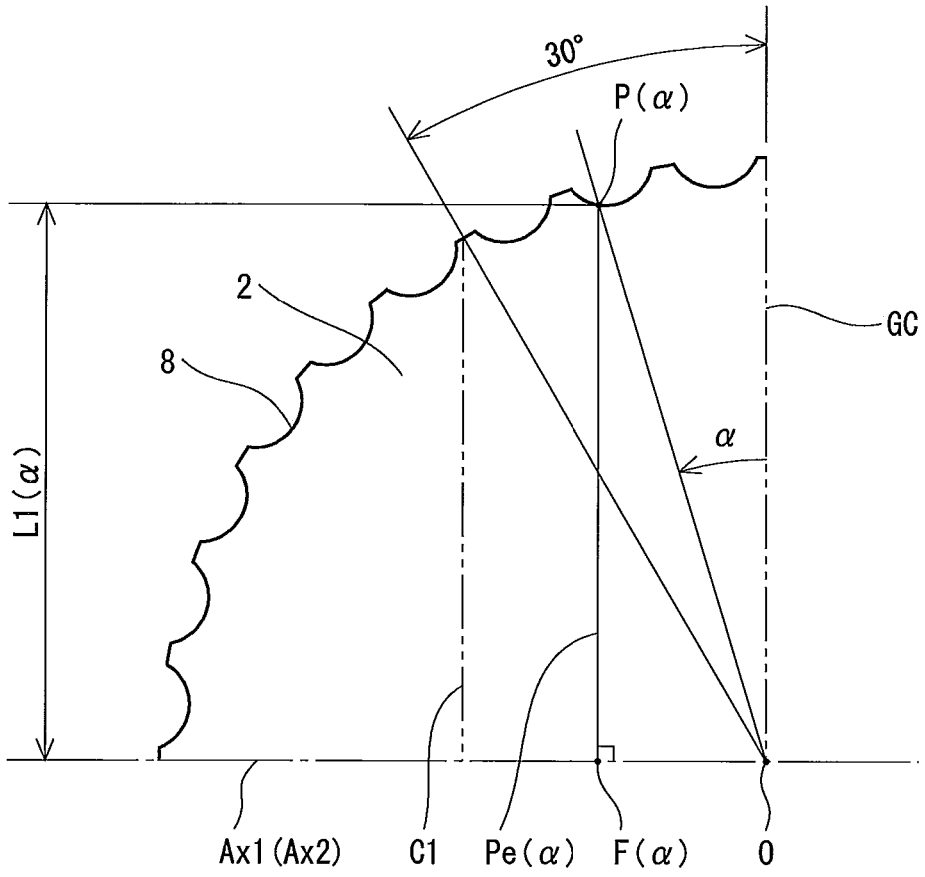
FIG. 9 is a schematic view for explaining the method for evaluating the golf ball in FIG. 1.

There is assumed a great circle GC that exists on the surface of the phantom sphere 12 of the golf ball 2 and is orthogonal to the first rotation axis Ax1. The circumferential speed of the great circle GC is faster than any other part of the golf ball 2 during rotation of the golf ball 2. In addition, there are assumed two small circles C1 and C2 that exist on the surface of the phantom sphere 12 of the golf ball 2 and are orthogonal to the first rotation axis Ax1. FIG. 9 schematically shows a partial cross-sectional view of the golf ball 2 in FIG. 8. In FIG. 9, the right-to-left direction is the direction of the first rotation axis Ax1. As shown in FIG. 9, the absolute value of the central angle between the small circle C1 and the great circle GC is 30°. Although not shown in the drawing, the absolute value of the central angle between the small circle C2 and the great circle GC is also 30°. The golf ball 2 is divided at the small circles C1 and C2, and of the surface of the golf ball 2, a region sandwiched between the small circles C1 and C2 is defined.

In FIG. 9, a point P(α) is the point that is located on the surface of the golf ball 2 and of which the central angle with the great circle GC is α° (degree). A point F(α) is a foot of a perpendicular line Pe(α) that extends downward from the point P(α) to the first rotation axis Ax1. What is indicated by an arrow L1(α) is the length of the perpendicular line Pe(α). In other words, the length L1(α) is the distance between the point P(α) and the first rotation axis Ax1. For one cross section, the lengths L1(α) are calculated at 21 points P(α). Specifically, the lengths L1(α) are calculated at angles α of −30°, −27°, −24°, −21°, −18°, −15°, −12°, −9°, −6°, −3°, 0°, 3°, 6°, 9°, 12°, 15°, 18°, 21°, 24°, 27°, and 30°. The 21 lengths L1(α) are summed to obtain a total length L2 (mm). The total length L2 is a parameter dependent on the surface shape in the cross section shown in FIG. 9.

Figure 10:
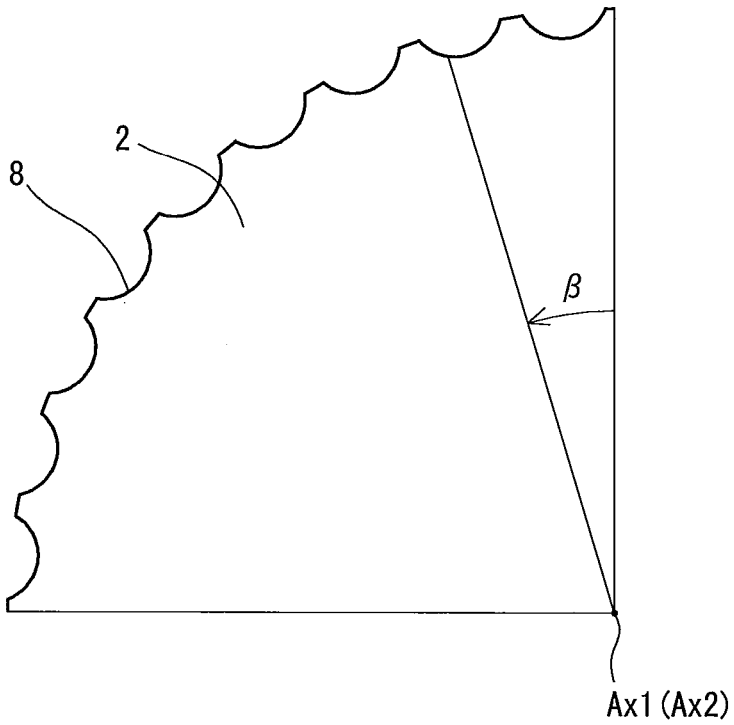
FIG. 10 is a schematic view for explaining the method for evaluating the golf ball in FIG. 1.

FIG. 10 shows a partial cross section of the golf ball 2. In FIG. 10, the direction perpendicular to the surface of the sheet is the direction of the first rotation axis Ax1. In FIG. 10, what is indicated by a reference sign β is a rotation angle of the golf ball 2. In a range equal to or greater than 0° and smaller than 360°, the rotation angles β are set at an interval of an angle of 0.25°. At each rotation angle, the total length L2 is calculated. As a result, 1440 total lengths L2 are obtained along the rotation direction. In other words, a first data constellation regarding a parameter dependent on a surface shape appearing at a predetermined point moment by moment during one rotation of the golf ball 2, is calculated. The first data constellation is calculated based on the 30240 lengths L1.

Figure 11:
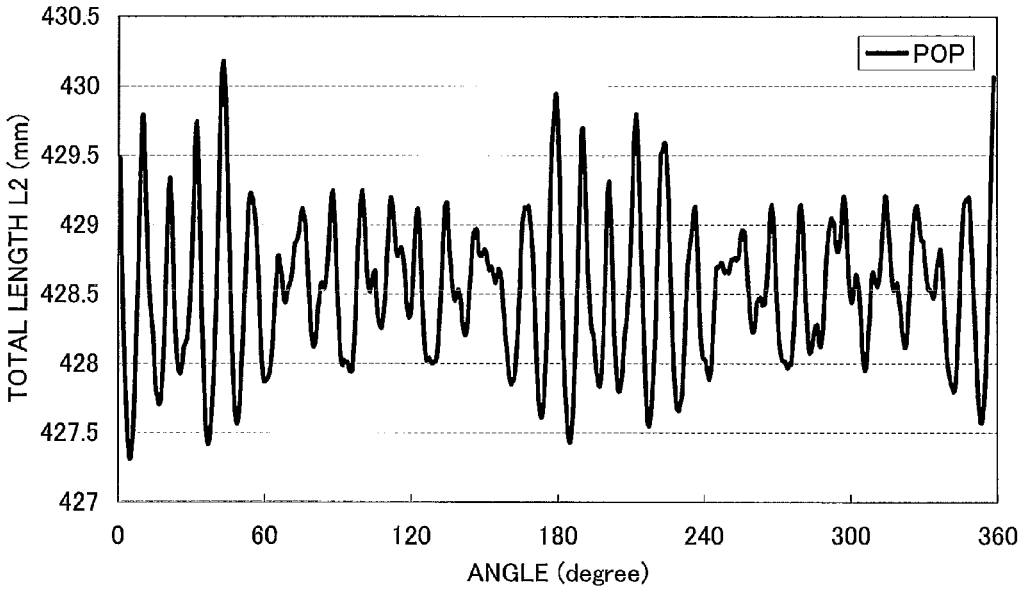
FIG. 11 is a graph showing an evaluation result of the golf ball in FIG. 3.

FIG. 11 shows a graph plotting the first data constellation of the golf ball 2 shown in FIGS. 3 and 4. In this graph, the horizontal axis indicates the rotation angle β, and the vertical axis indicates the total length L2. Fourier transformation is performed on the first data constellation. By the Fourier transformation, a frequency spectrum is obtained. In other words, by the Fourier transformation, a coefficient of a Fourier series represented by the following mathematical formula is obtained.

$$F_k = \sum_{n=0}^{N-1}\left(a_n \cos 2\pi\frac{nk}{N} + b_n \sin 2\pi\frac{nk}{N}\right)$$

The above mathematical formula is a combination of two trigonometric functions having different periods. In the above mathematical formula, $a_n$ and $b_n$ are Fourier coefficients. The magnitude of each component synthesized is determined depending on these Fourier coefficients. The coefficients are represented by the following mathematical formulas, respectively.

$$a_n = \frac{1}{N}\sum_{k=0}^{N-1} F_k \cos 2\pi\frac{nk}{N}$$

$$b_n = \frac{1}{N}\sum_{k=0}^{N-1} F_k \sin 2\pi\frac{nk}{N}$$

In these mathematical formulas, N is the total number of pieces of data of the first data constellation, and $F_k$ is the kth value in the first data constellation. The spectrum is represented by the following mathematical formula.

$$P_n = \sqrt{a_n^2 + b_n^2}$$

Figure 12:
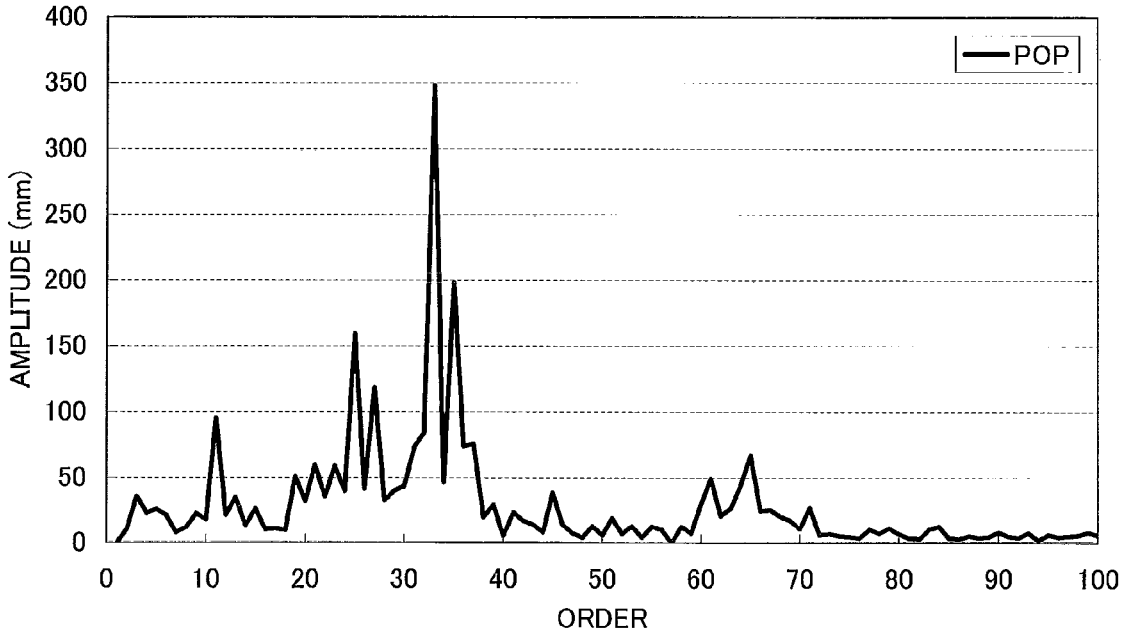
FIG. 12 is a graph showing another evaluation result of the golf ball in FIG. 3.

By the Fourier transformation, a first transformed data constellation is obtained. FIG. 12 shows a graph plotting the first transformed data constellation. In this graph, the horizontal axis indicates an order, and the vertical axis indicates an amplitude. On the basis of this graph, the maximum peak is determined. Further, the peak value Pd1 of the maximum peak and the order Fd1 of the maximum peak are determined. The peak value Pd1 and the order Fd1 are numeric values indicating the aerodynamic characteristic during PH rotation.

Moreover, a second rotation axis Ax2 orthogonal to the first rotation axis Ax1 is determined. Rotation of the golf ball 2 about the second rotation axis Ax2 is referred to as POP rotation. Similarly as for PH rotation, for POP rotation, a great circle GC and two small circles C1 and C2 are assumed. The absolute value of the central angle between the small circle C1 and the great circle GC is 30°. The absolute value of the central angle between the small circle C2 and the great circle GC is also 30°. For a region, sandwiched between the small circles C1 and C2, of the surface of the golf ball 2, 1440 total lengths L2 are calculated. In other words, a second data constellation regarding a parameter dependent on a surface shape appearing at a predetermined point moment by moment during one rotation of the golf ball 2, is calculated.

Figure 13:
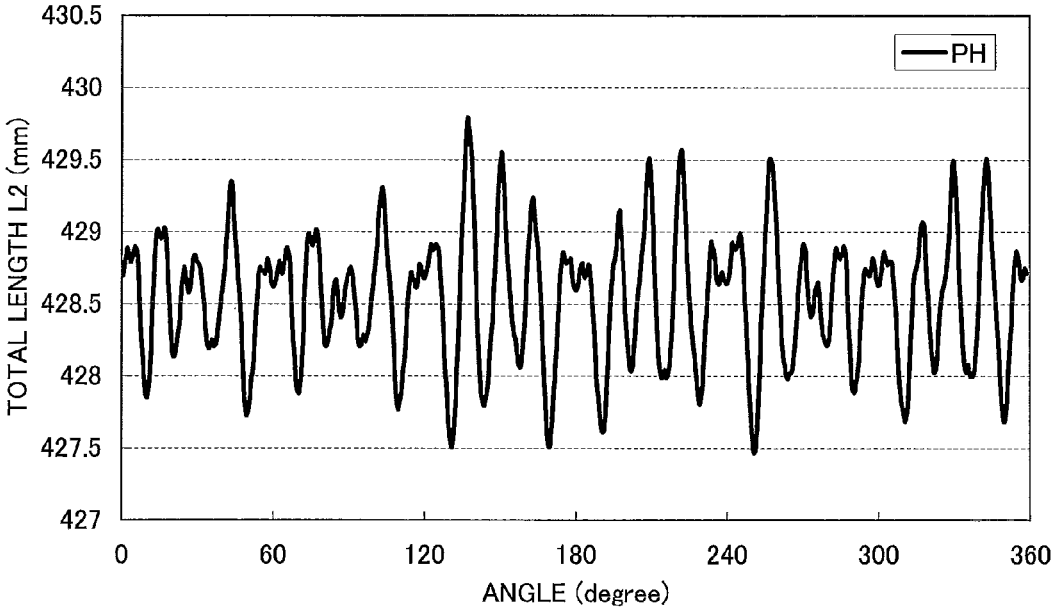
FIG. 13 is a graph showing another evaluation result of the golf ball in FIG. 3.
Figure 14:
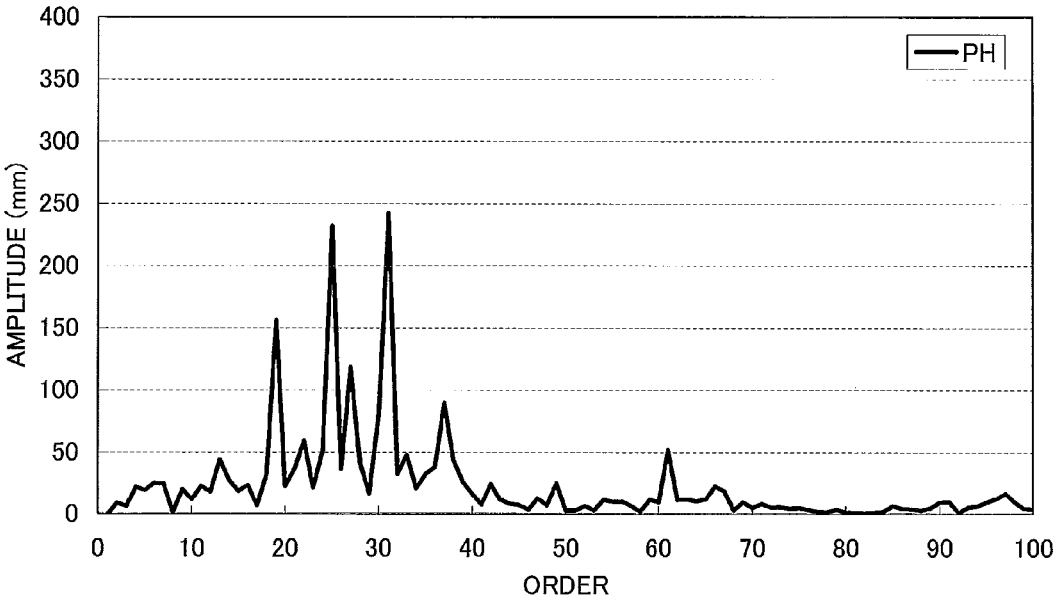
FIG. 14 is a graph showing another evaluation result of the golf ball in FIG. 3.

FIG. 13 shows a graph plotting the second data constellation of the golf ball 2 shown in FIGS. 3 and 4. In this graph, the horizontal axis indicates the rotation angle β, and the vertical axis indicates the total length L2. Fourier transformation is performed on the second data constellation to obtain a second transformed data constellation. FIG. 14 shows a graph plotting the second transformed data constellation. In this graph, the horizontal axis indicates an order, and the vertical axis indicates an amplitude. On the basis of this graph, the maximum peak is determined. Further, the peak value Pd2 of the maximum peak and the order Fd2 of the maximum peak are determined. The peak value Pd2 and the order Fd2 are numeric values indicating the aerodynamic characteristic during POP rotation.

As is obvious from FIGS. 11 to 14, the Fourier transformation facilitates comparison of the aerodynamic characteristic during PH rotation and the aerodynamic characteristic during POP rotation.

There are numerous straight lines orthogonal to the first rotation axis Ax1. A straight line of which the corresponding great circle GC contains the most number of dimple 8 centers substantially located therein is set as the second rotation axis Ax2. When there are in reality a plurality of straight lines of which the corresponding great circles GC each contain the most number of dimple 8 centers substantially located therein, the peak value is calculated for each of the cases where these straight lines are set as second rotation axes Ax2. The maximum value of these peak values is the peak value Pd2.

In light of aerodynamic symmetry, the absolute value of the difference (Pd1−Pd2) is preferably equal to or less than 150 mm and particularly preferably equal to or less than 110 mm. Ideally, the difference is zero.

In light of aerodynamic symmetry, the absolute value of the difference (Fd1−Fd2) is preferably equal to or less than 10, more preferably equal to or less than 8, and particularly preferably equal to or less than 4. Ideally, the difference is zero.

Embodiment 2

Figure 15:
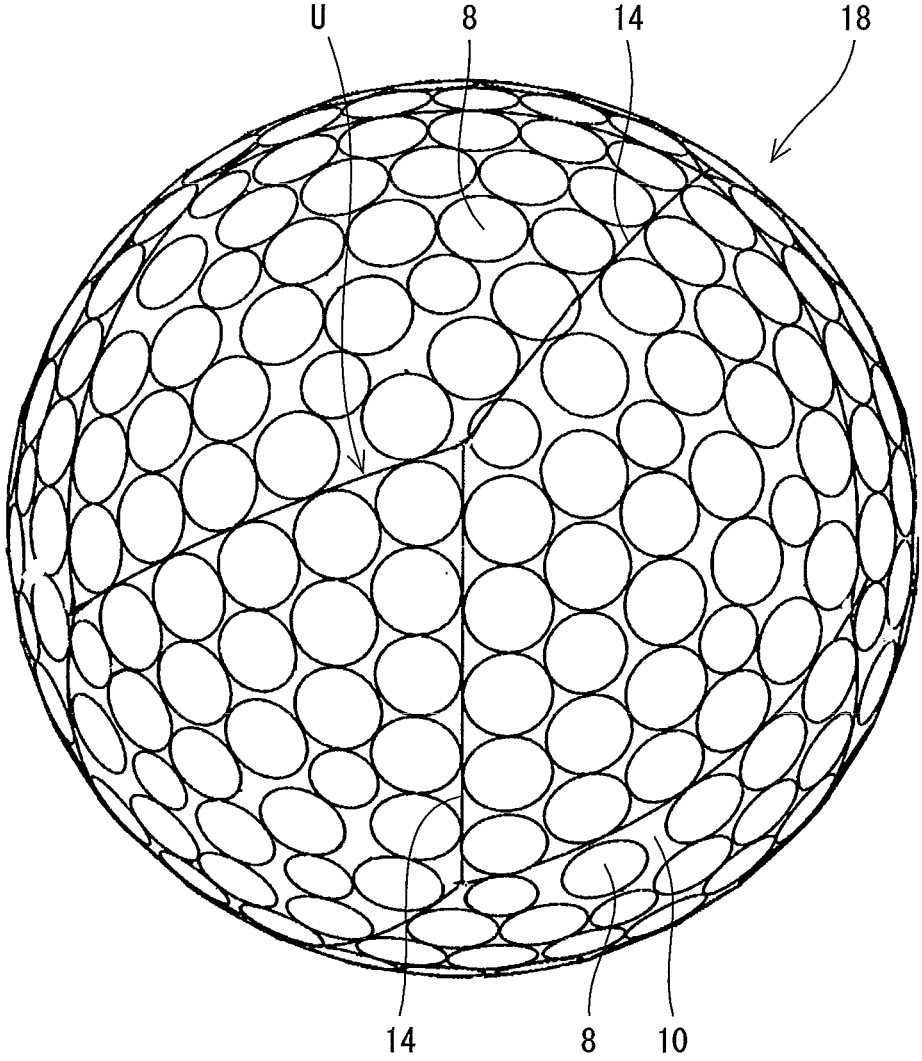
FIG. 15 is a front view of a golf ball according to another embodiment of the present invention.
Figure 16:
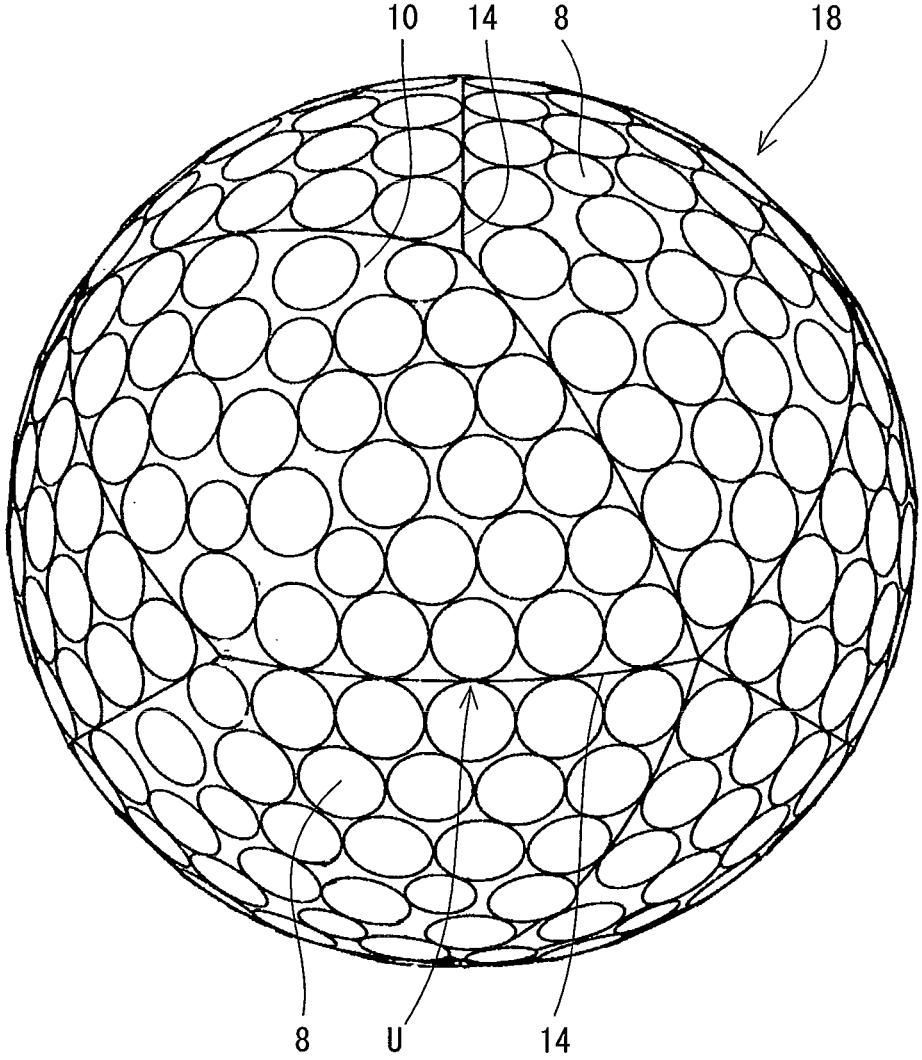
FIG. 16 is a plan view of the golf ball in FIG. 15.

FIG. 15 is a front view of a golf ball 18 according to another embodiment of the present invention. FIG. 16 is a plan view of the golf ball 18 in FIG. 15. FIGS. 15 and 16 show some of division lines 14 obtained by projecting the edge lines of the regular icosahedron inscribed in a phantom sphere, on the surface of the phantom sphere. The rest of the division lines is not shown in FIGS. 15 and 16.

Figure 17:
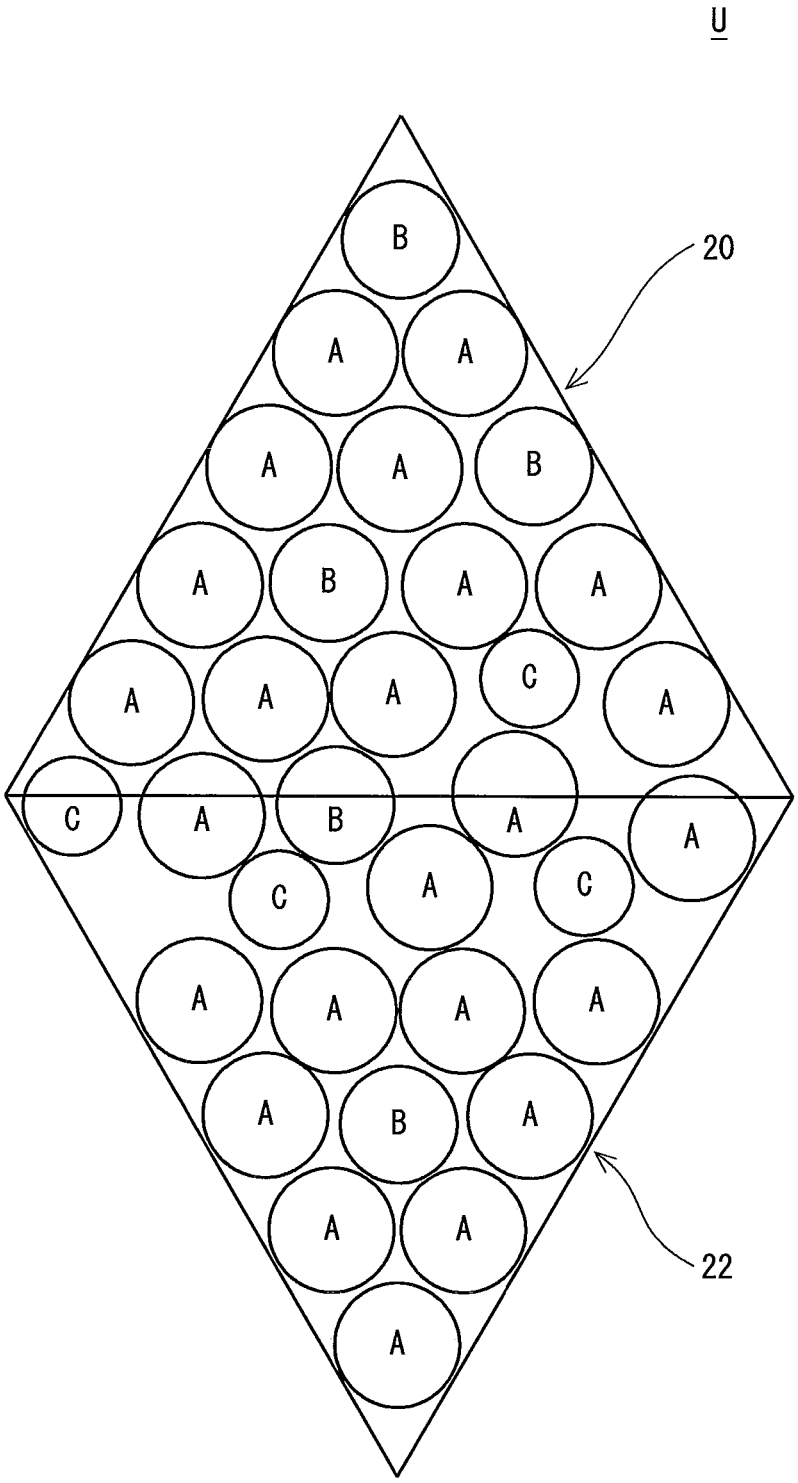
FIG. 17 is a schematic view of a base pattern of the golf ball in FIG. 15.

By projecting the edge lines of the regular icosahedron on the surface of the phantom sphere, 20 spherical regular triangles are obtained. In the embodiment, one unit is assumed by combining two adjacent spherical regular triangles. The number of units is 10. FIG. 17 shows one unit U. The unit U is a combination of a first spherical regular triangle 20 and a second spherical regular triangle 22. One spherical regular triangle may be one unit U.

FIG. 17 shows a base pattern. In the base pattern, a plurality of dimples is randomly arranged in the unit U such that the dimples do not overlap each other. The unit U has dimples A each having a diameter of 4.30 mm; dimples B each having a diameter of 4.10 mm; and dimples C each having a diameter of 3.4 mm. The number of the dimples A is 24. The number of the dimples B is 5. The number of the dimples C is 4. The diameter and the number of the types of the dimples 8 are decided by a designer.

The base pattern is developed over the other units U. When developed, the base pattern may be transferred to the other units U without changing the base pattern. When developed, a pattern obtained by mirror-inverting the base pattern may be transferred to the other units U. A pattern obtained by repeating the mirror inversion two or more times may be transferred to the other units U. As a result of completion of the transfer to all the units U, a pattern having 240 dimples A, 50 dimples B, and 40 dimples C is obtained.

Figure 18:
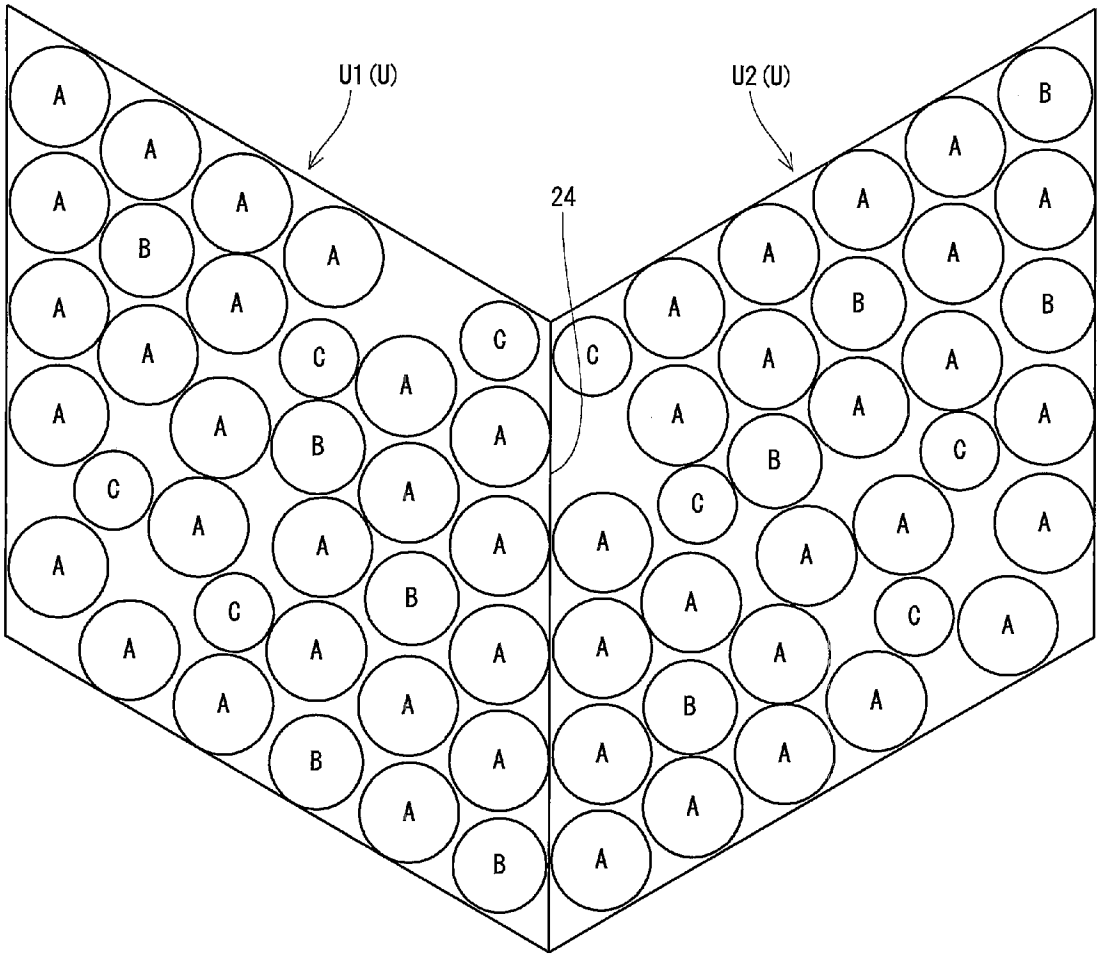
FIG. 18 is a schematic view of a pattern in which the base pattern in FIG. 17 is developed.

FIG. 18 shows a first unit U1 and a second unit U2. The pattern of the first unit U1 and the pattern of the second unit U2 are not mirror-symmetrical to each other with respect to the plane passing through a boundary line 24 and the center of the golf ball 18. Two units U that are not mirror-symmetrical to each other can contribute to the aerodynamic symmetry of the golf ball 18.

Figure 19:
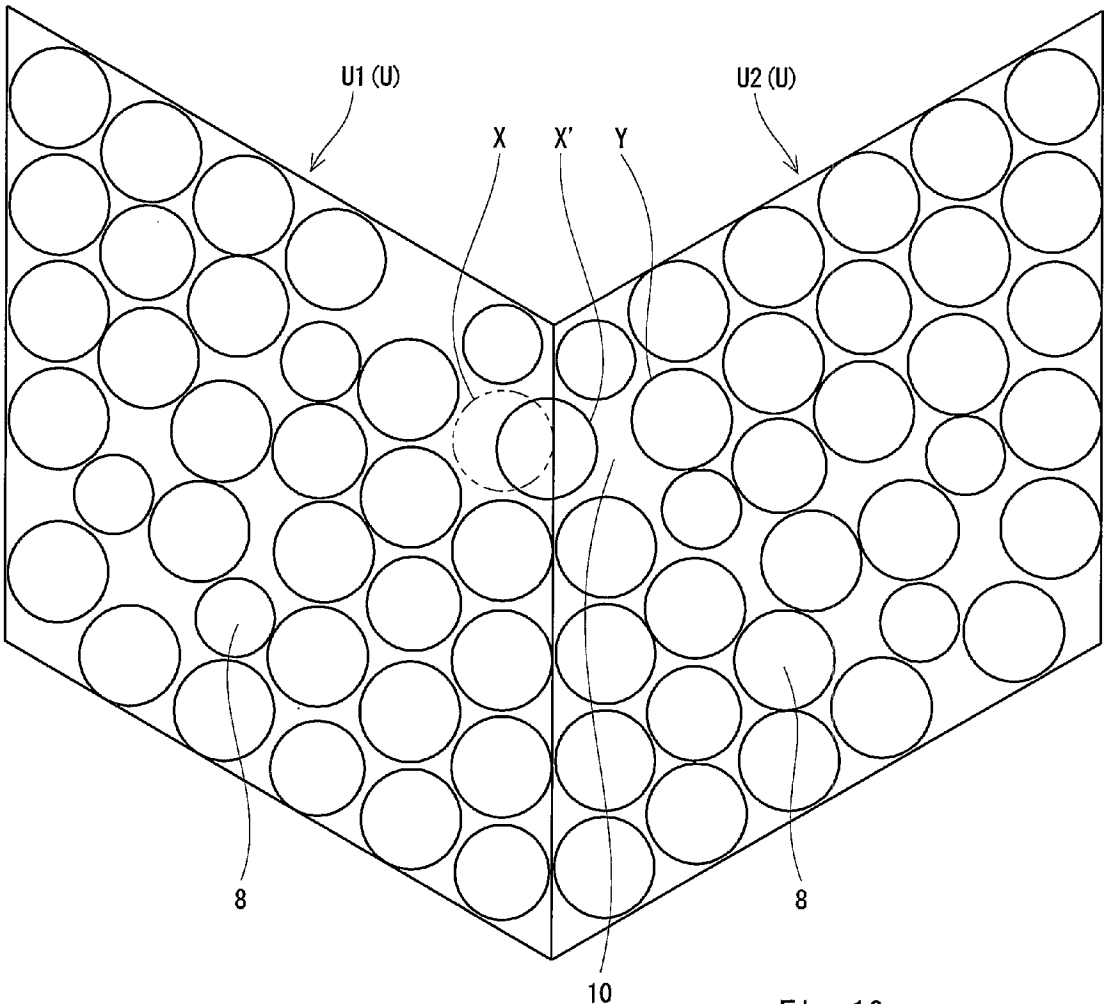
FIG. 19 is a schematic view of a pattern obtained by correcting the pattern in FIG. 18.

FIG. 19 is a schematic view of a pattern obtained by correcting the pattern in FIG. 18. The correction is performed by moving a dimple 8. In FIG. 19, what is indicated by a reference sign X is the dimple before the movement, and what is indicated by a reference sign X' is the dimple after the movement. The distance between the dimple X and a dimple Y is large. Thus, a large land 10 exists between the dimple X and the dimple Y. The large land 10 impairs the flight performance of the golf ball 18. The distance between the dimple X' and the dimple Y is small. Thus, no large land 10 exists between the dimple X' and the dimple Y. By correcting the position of the dimple 8 in the vicinity of the boundary between the two adjacent units U such that the distance between the two adjacent dimples 8 is reduced, excellent flight performance of the golf ball 18 can be achieved.

In the vicinity of the boundary between the two adjacent units U, the positions of the dimples 8 may be corrected such that three or more dimples 8 are not arranged along a line. By this correction as well, excellent flight performance of the golf ball 18 can be achieved.

The dimples 8 are randomly arranged in each unit U, and the pattern of one unit U and the pattern of another unit U are not mirror-symmetrical to each other. Thus, the golf ball 18 has excellent aerodynamic symmetry. In the designing method, a pattern having excellent aerodynamic symmetry can be obtained easily in a short time. In the designing method, the designer decides the diameter and the number of the types of the dimples 8. Thus, a dimple pattern in which an intention of the designer is reflected can be obtained.

In the golf ball 18, the number of pairs of adjacent units is 20. Ideally, a state where the pattern of one unit U and the pattern of the other unit U are not mirror-symmetrical to each other is achieved in all the pairs of the adjacent units. In some of the pairs of the adjacent units, the pattern of one unit U and the pattern of the other unit U may be mirror-symmetrical to each other. In light of aerodynamic symmetry of the golf ball 18, the ratio Pn of the number of pairs of adjacent units that are not mirror-symmetrical to each other, to the total number of the pairs of the adjacent units is preferably equal to or greater than 50%, more preferably equal to or greater than 65%, and particularly preferably equal to or greater than 80%. In the dimple pattern shown in FIGS. 15 and 16, the ratio Pn is 100%.

The units U may be obtained by projecting the edge lines of the regular octahedron inscribed in the phantom sphere, on the surface of the phantom sphere.

Embodiment 3

Figure 20:
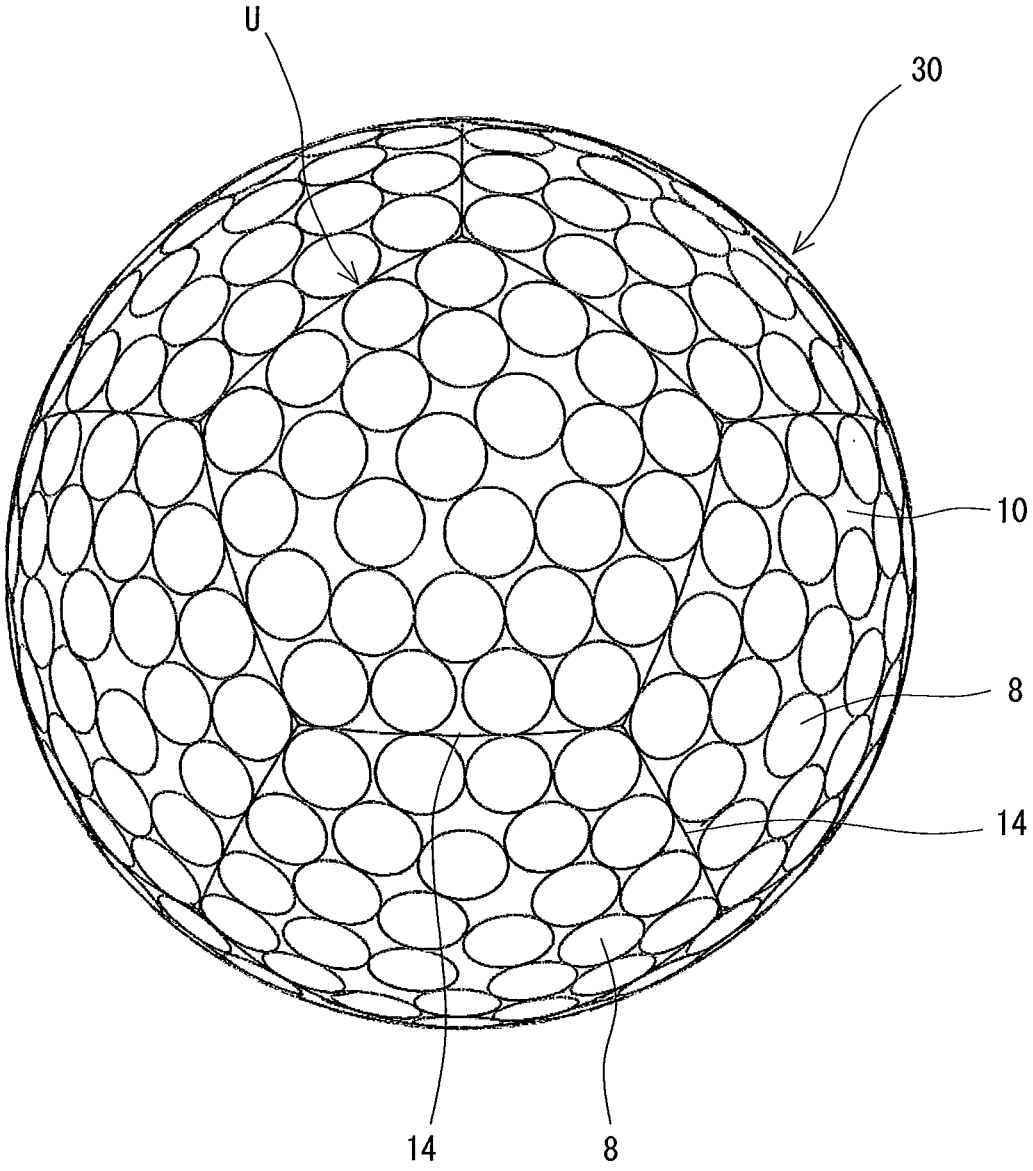
FIG. 20 is a front view of a golf ball according to still another embodiment of the present invention.
Figure 21:
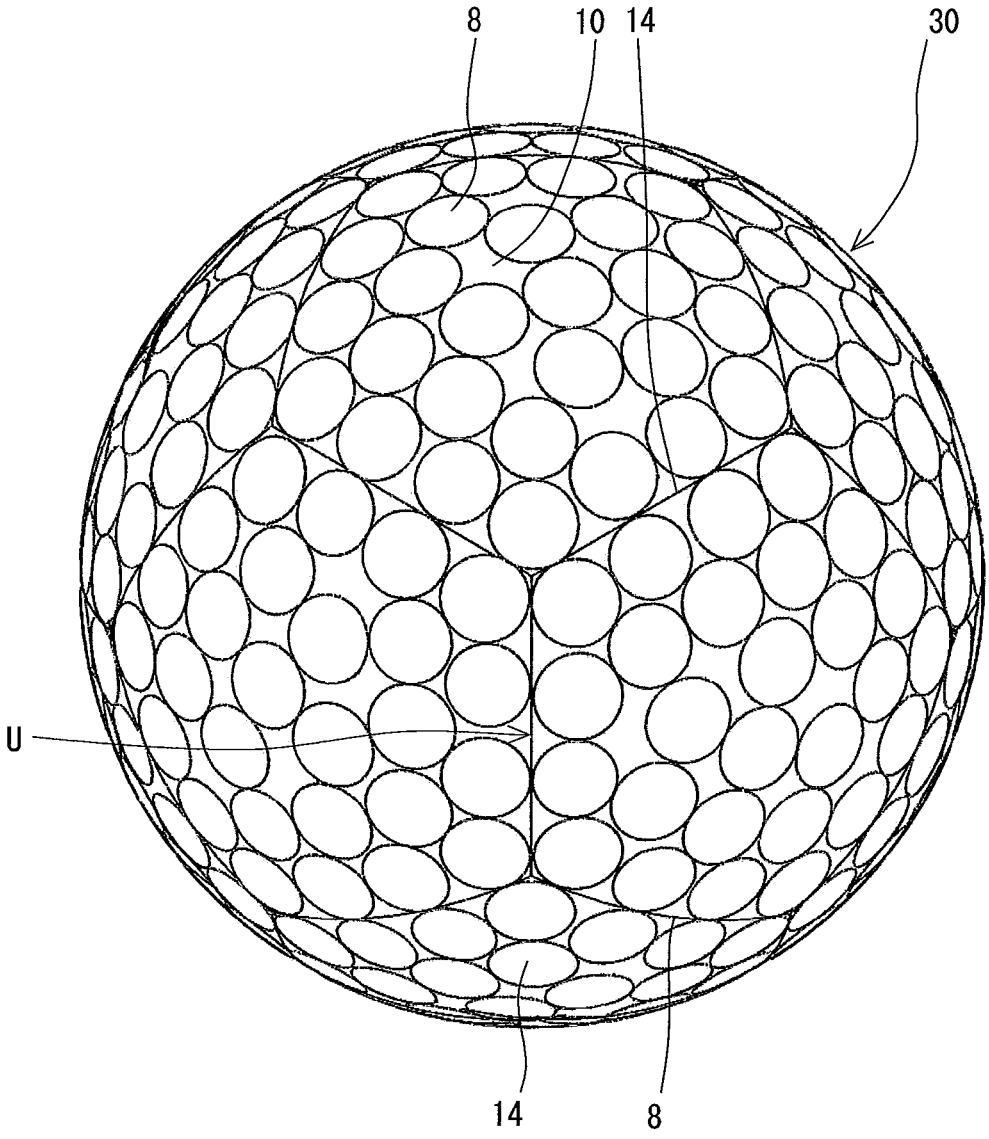
FIG. 21 is a plan view of the golf ball in FIG. 20.

FIGS. 20 and 21 show a dimple pattern of a golf ball 30 according to Embodiment 3. FIGS. 20 and 21 show division lines obtained by projecting the edge lines of the regular dodecahedron inscribed in a phantom sphere, on the surface of the phantom sphere. In the actual golf ball 30, the division lines 14 are not viewed. By these division lines 14, the surface of the phantom sphere is divided into 12 units U. The procedure of this division is the same as that of the golf ball 2 according to Embodiment 1.

The base pattern of the golf ball 30 is the same as the base pattern according to Embodiment 1 shown in FIG. 5. In the golf ball 30, the pattern of one unit U and the pattern of the other unit U are not mirror-symmetrical to each other in all pairs of adjacent units. The ratio Pn of the golf ball 30 is 100%.

Evaluation

The aerodynamic symmetries of golf balls according to Embodiments 1 to 3 and Comparative Examples 1 and 2 are evaluated. Prior to the evaluation, the specifications of dimples are determined as shown in Table 1 below.

TABLE 1

Specifications of Dimples

| | Type | Number in unit | Total number | Diameter (mm) | Depth (mm) |
|---|---|---|---|---|---|
| Embodiment 1 | A | 20 | 240 | 4.30 | 0.1436 |
| | B | 7 | 84 | 4.10 | 0.1436 |
| Embodiment 2 | A | 24 | 240 | 4.30 | 0.1440 |
| | B | 5 | 50 | 4.10 | 0.1440 |
| | C | 4 | 40 | 3.40 | 0.1440 |
| Embodiment 3 | A | 20 | 240 | 4.30 | 0.1436 |
| | B | 7 | 84 | 4.10 | 0.1436 |
| Compara. Example 1 | A | — | 120 | 3.80 | 0.1711 |
| | B | — | 152 | 3.50 | 0.1711 |
| | C | — | 60 | 3.20 | 0.1711 |
| | D | — | 60 | 3.00 | 0.1711 |
| Compara. Example 2 | A | — | 170 | 4.10 | 0.1489 |
| | B | — | 120 | 3.90 | 0.1489 |
| | C | — | 60 | 3.60 | 0.1489 |
| | D | — | 12 | 2.70 | 0.1489 |

By the aforementioned method, Pd1, Pd2, Fd1 and Fd2 of each golf ball are calculated. The results are shown in Table 2 below.

TABLE 2

Results of Evaluation

Figure 22:
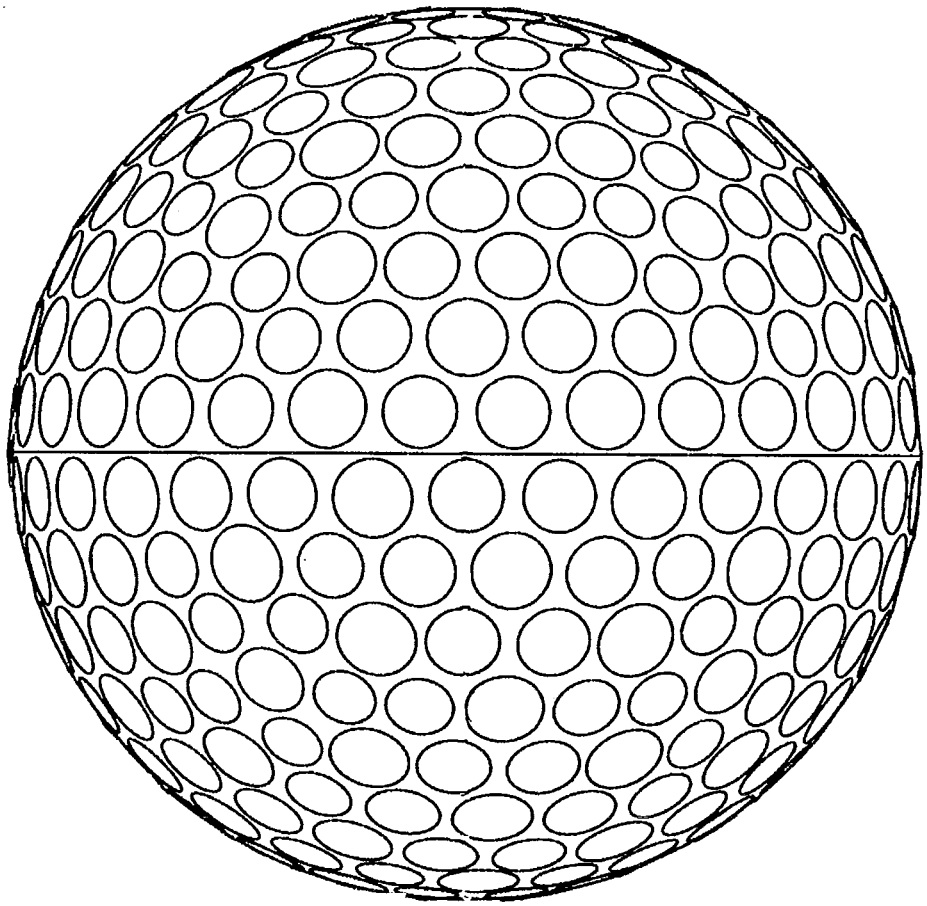
FIG. 22 is a front view of a golf ball according to Comparative Example 1.
Figure 23:
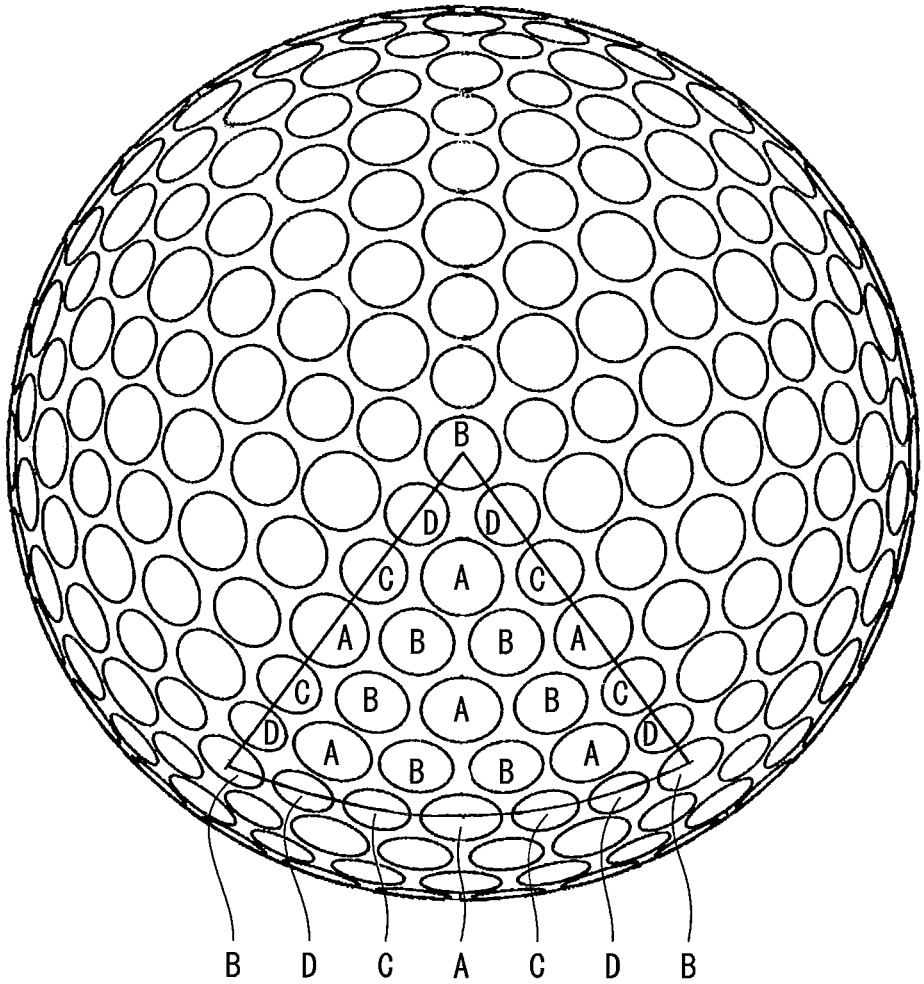
FIG. 23 is a plan view of the golf ball in FIG. 22.
Figure 24:
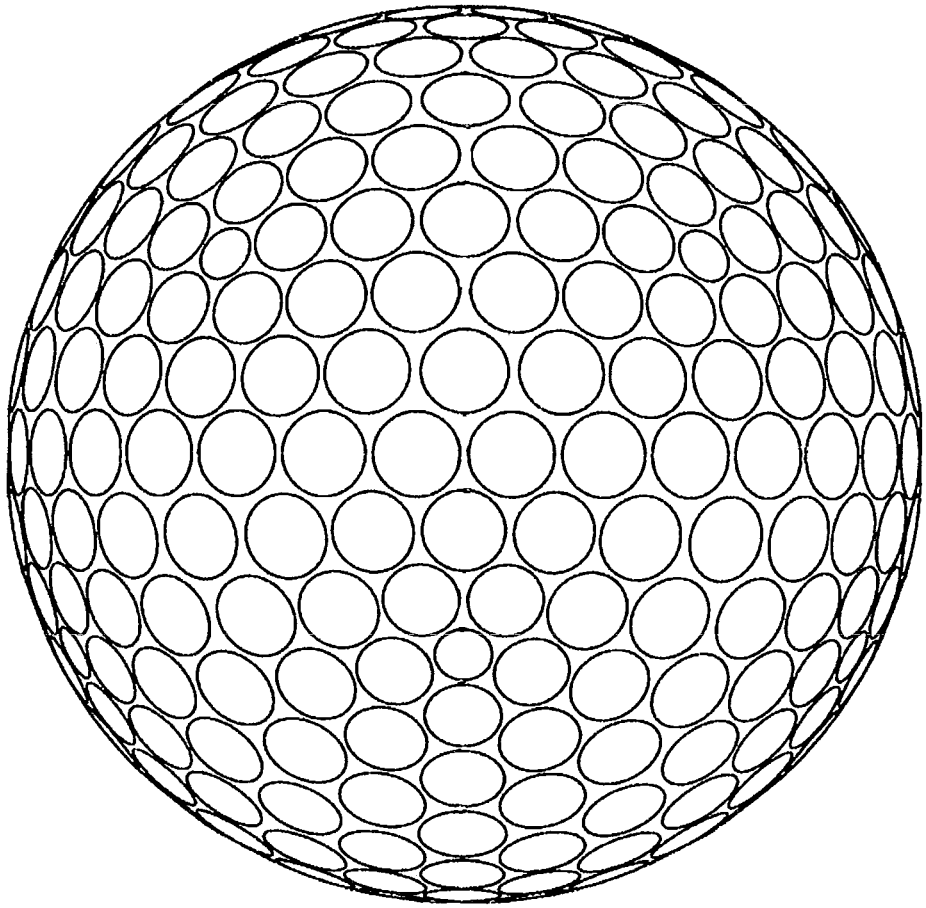
FIG. 24 is a front view of a golf ball according to Comparative Example 2.
Figure 25:
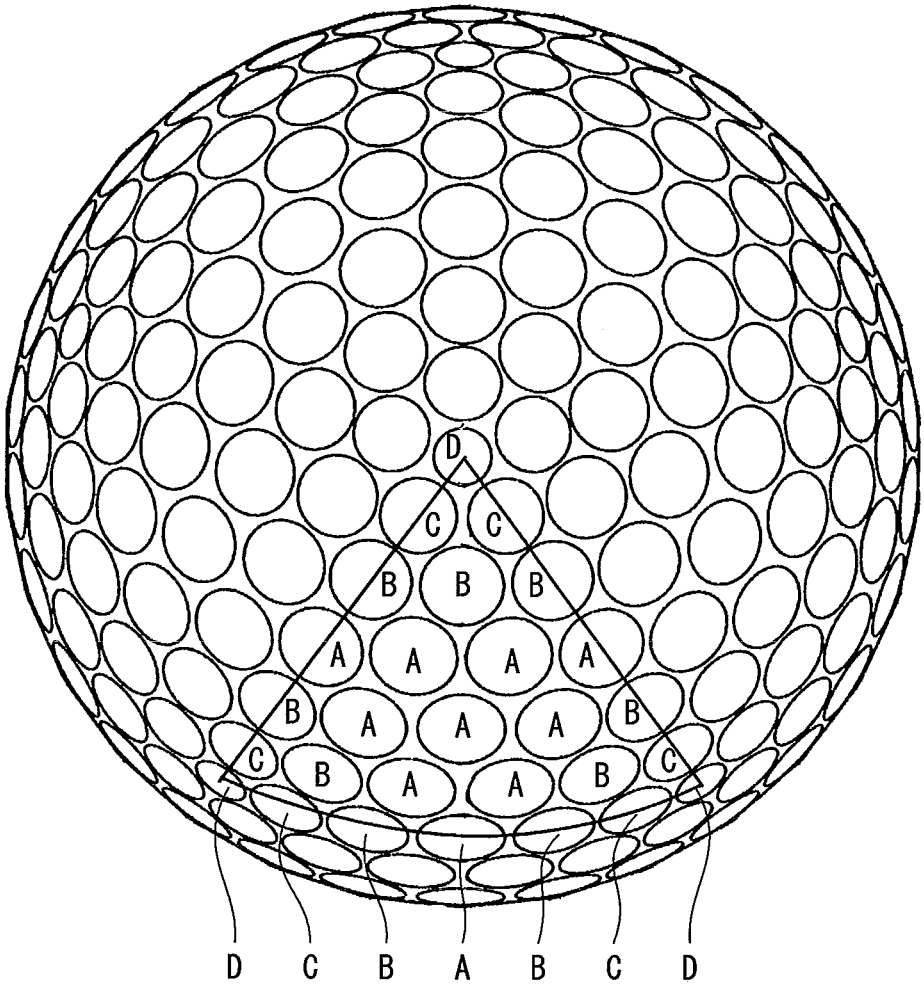
FIG. 25 is a plan view of the golf ball in FIG. 24.

| | Embodiment 1 | Embodiment 2 | Embodiment 3 | Compara. Example 1 | Compara. Example 2 |
|---|---|---|---|---|---|
| Front view | FIG. 3 | FIG. 15 | FIG. 20 | FIG. 22 | FIG. 24 |
| Plan view | FIG. 4 | FIG. 16 | FIG. 21 | FIG. 23 | FIG. 25 |
| Dimples | 324 | 330 | 324 | 392 | 362 |
| Total volume ($mm^3$) | 325 | 325 | 325 | 320 | 325 |
| Great circle paths | 0 | 0 | 0 | 1 | 0 |
| Polyhedron | Regular dodecahedron | Regular icosahedron | Regular dodecahedron | Icosahedron | Regular icosahedron |
| Units | 12 | 10 | 12 | — | — |
| Ratio Pn (%) | 96.7 | 100 | 100 | — | — |

TABLE 2-continued

Figure 26:
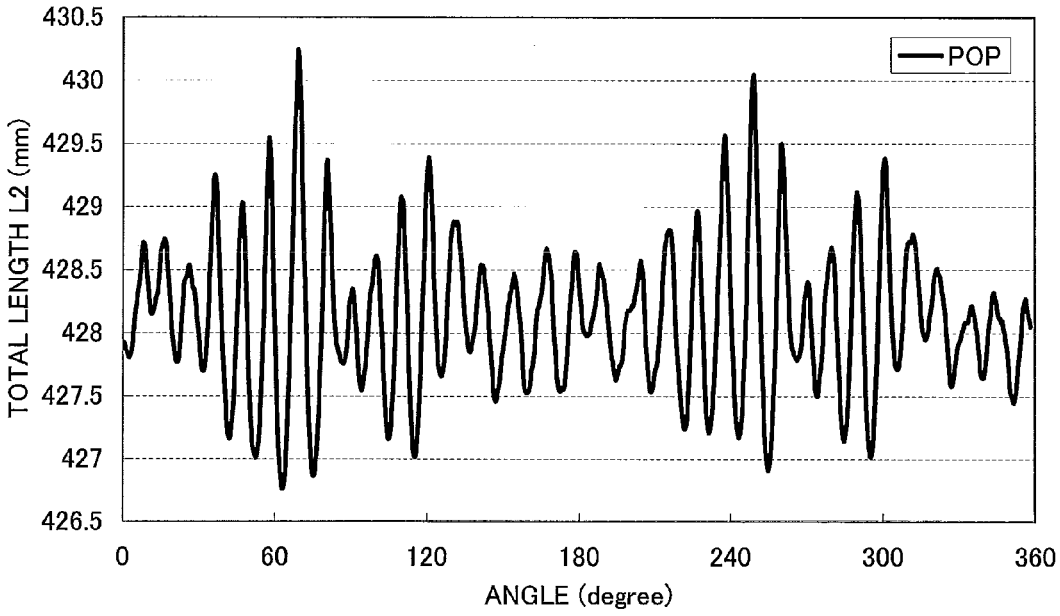
FIG. 26 is a graph showing an evaluation result of the golf ball in FIG. 15.
Figure 27:
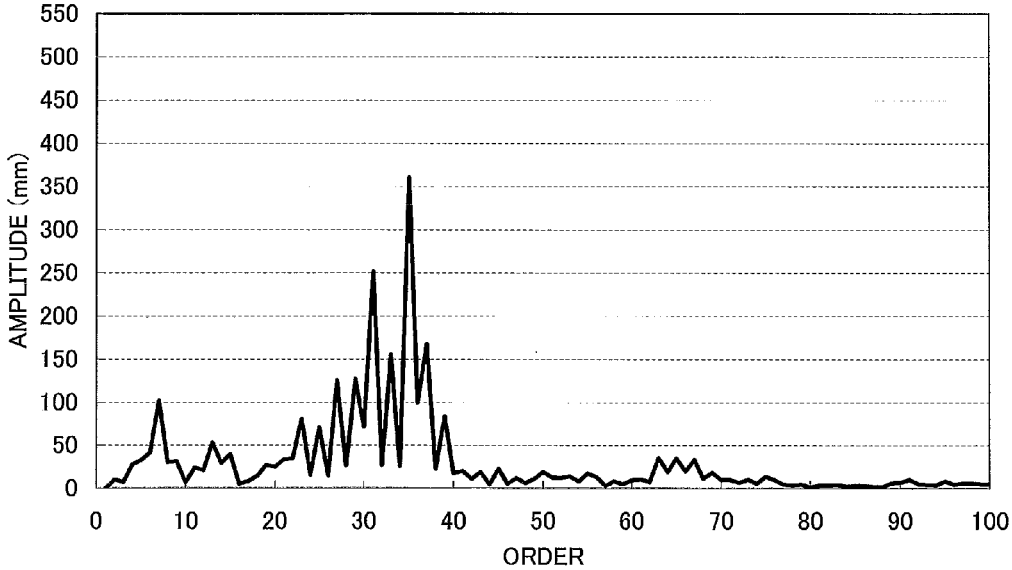
FIG. 27 is a graph showing another evaluation result of the golf ball in FIG. 15.
Figure 28:
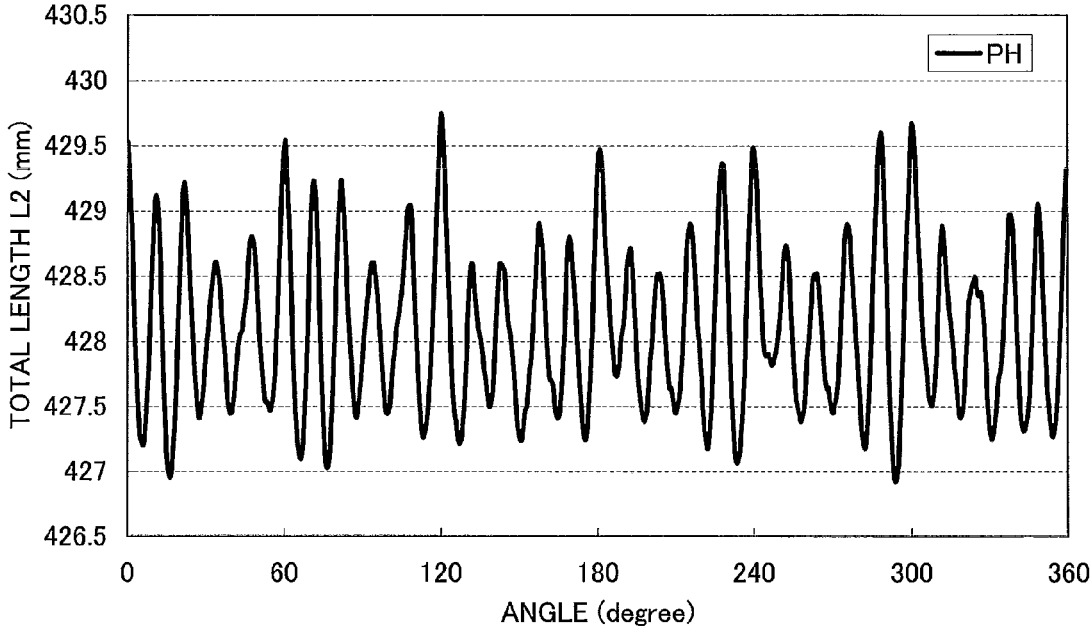
FIG. 28 is a graph showing another evaluation result of the golf ball in FIG. 15.
Figure 29:
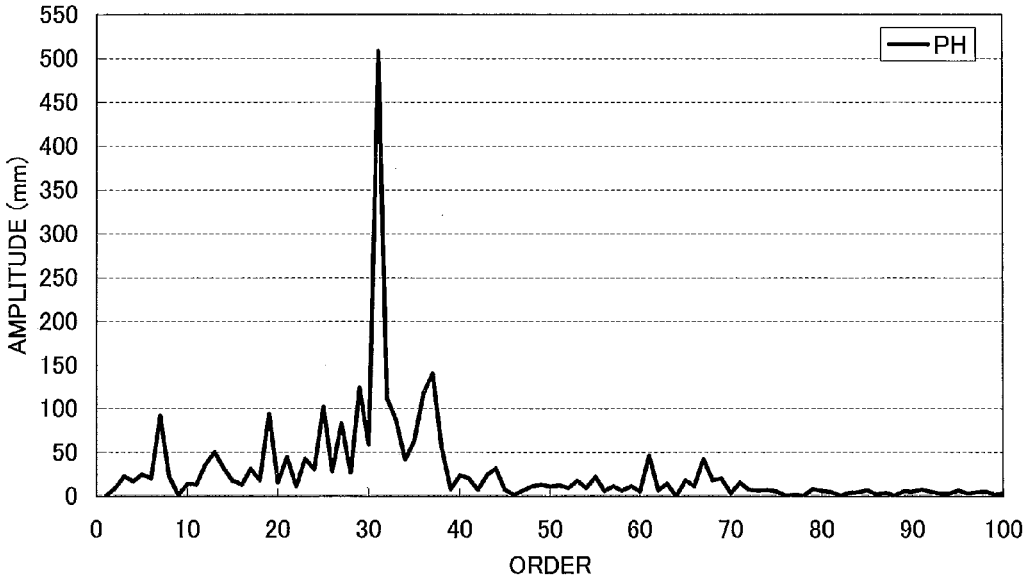
FIG. 29 is a graph showing another evaluation result of the golf ball in FIG. 15.
Figure 30:
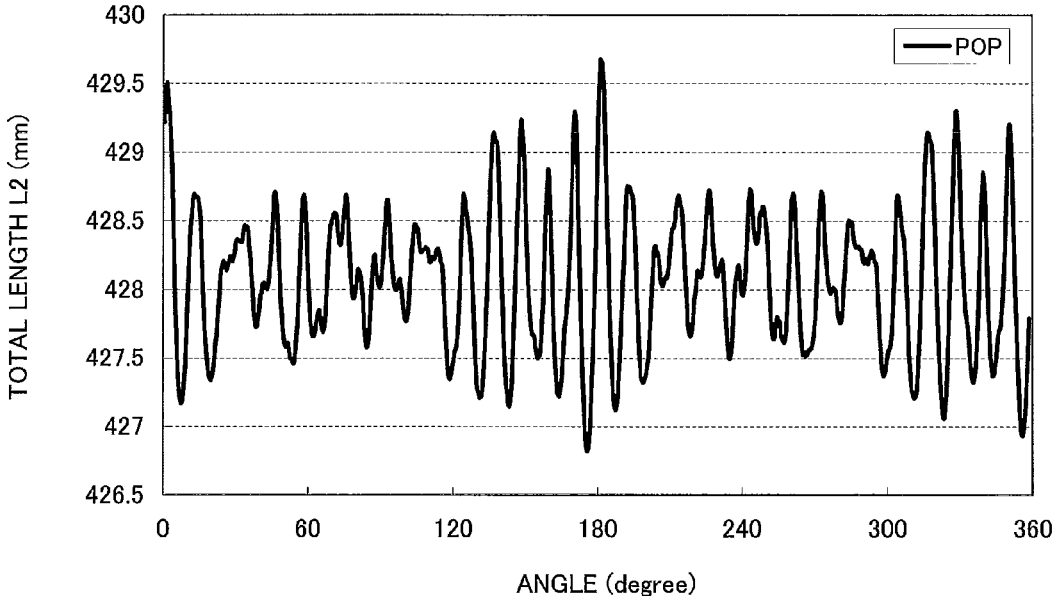
FIG. 30 is a graph showing an evaluation result of the golf ball in FIG. 20.
Figure 31:
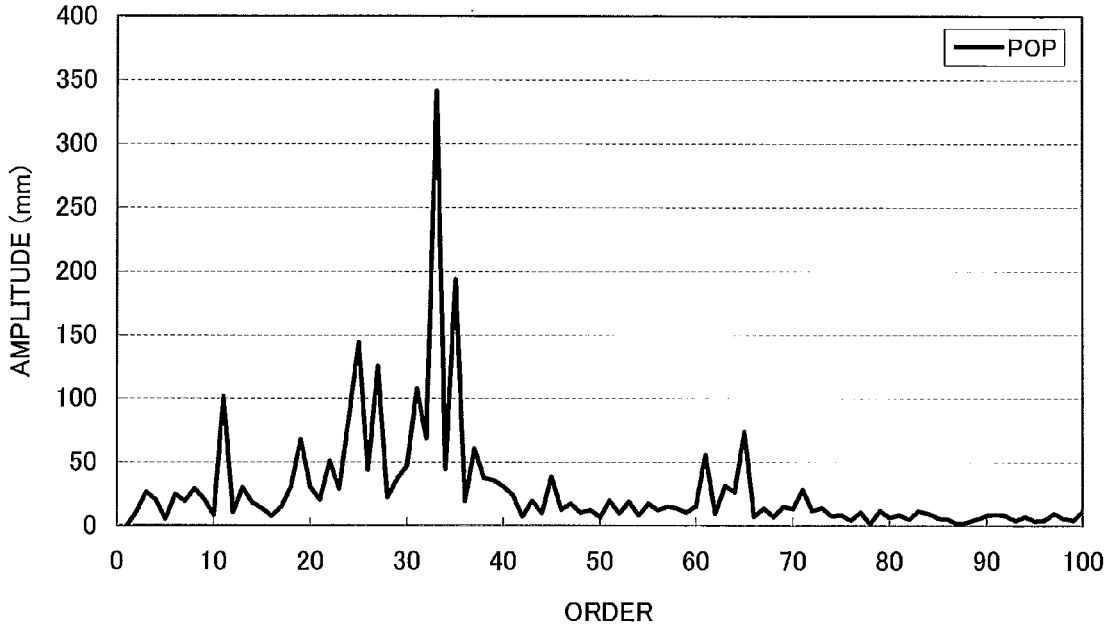
FIG. 31 is a graph showing another evaluation result of the golf ball in FIG. 20.
Figure 32:
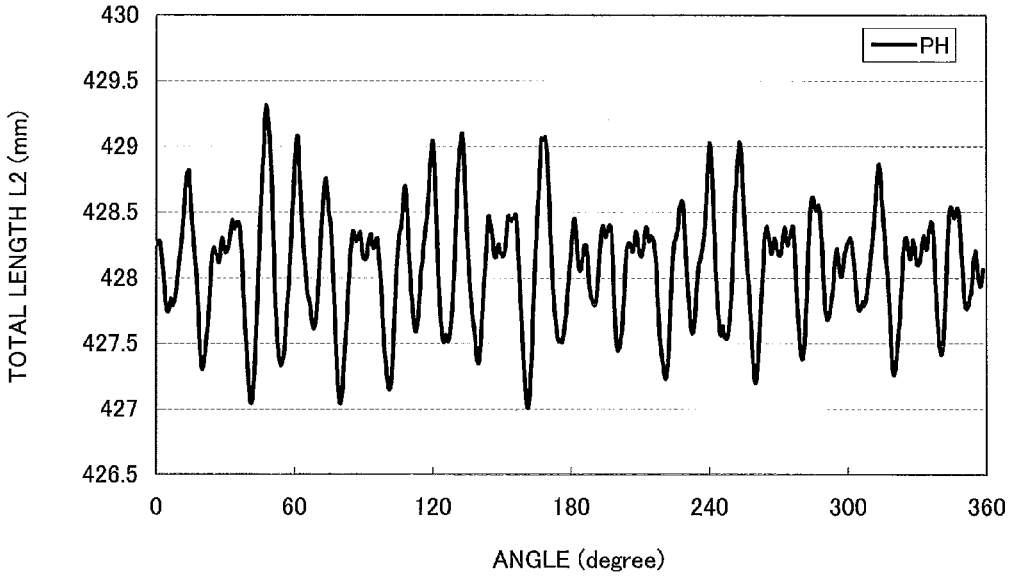
FIG. 32 is a graph showing another evaluation result of the golf ball in FIG. 20.
Figure 33:
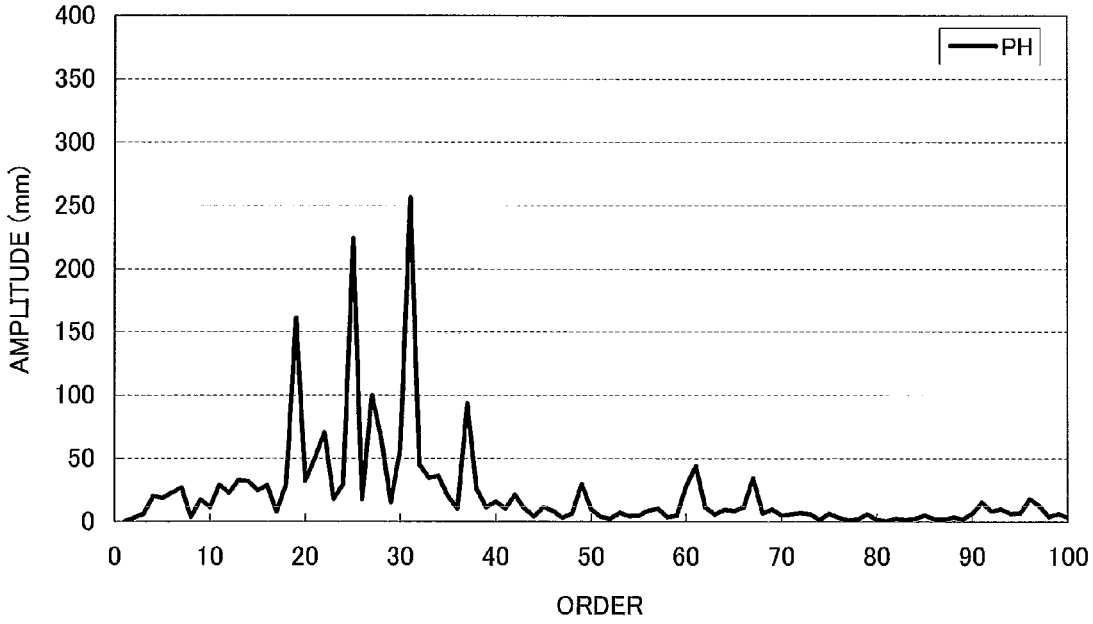
FIG. 33 is a graph showing another evaluation result of the golf ball in FIG. 20.
Figure 34:
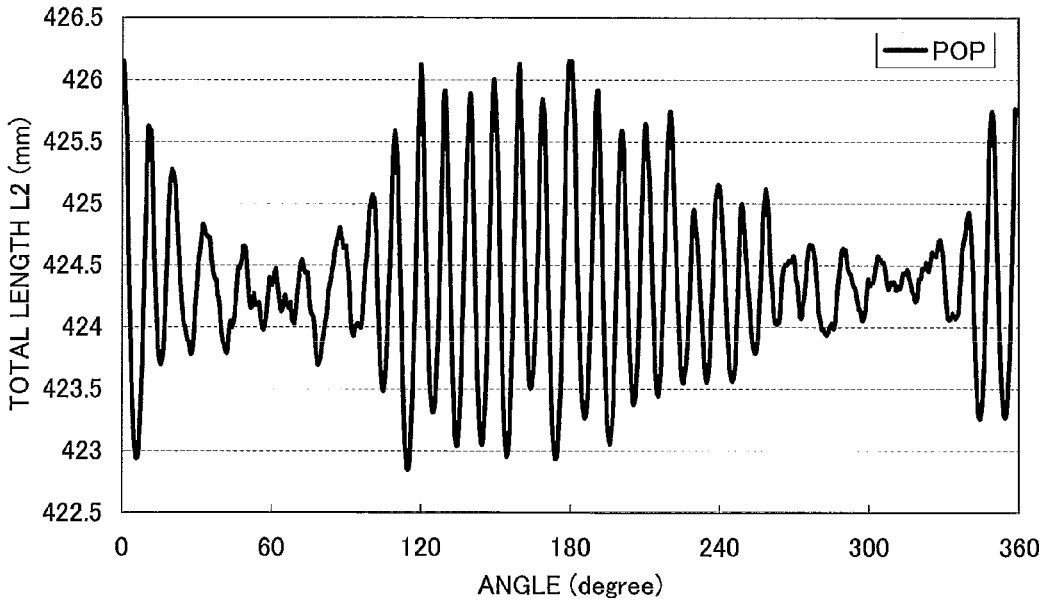
FIG. 34 is a graph showing an evaluation result of the golf ball in FIG. 22.
Figure 35:
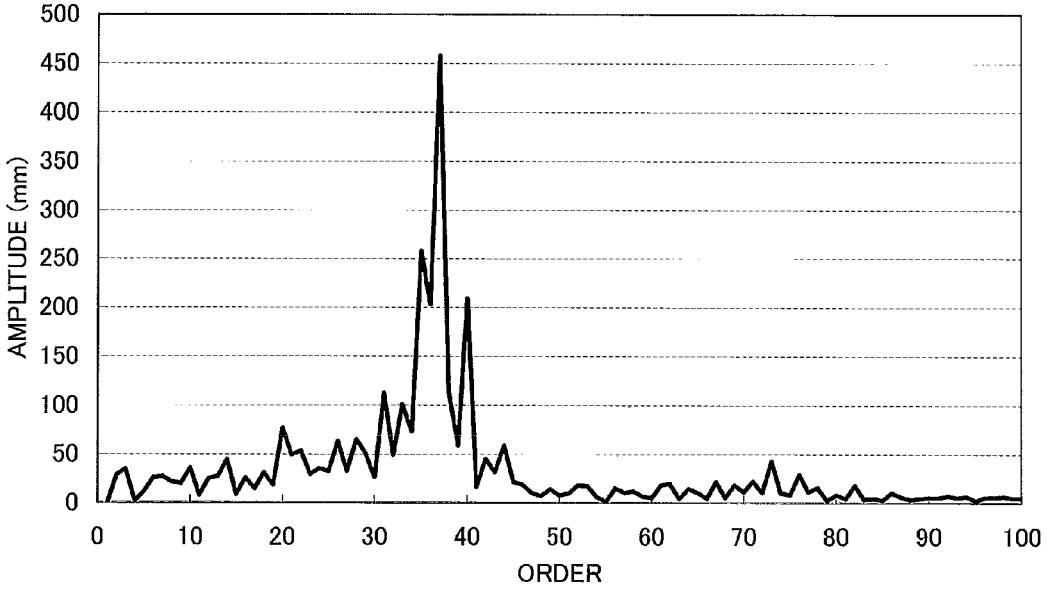
FIG. 35 is a graph showing another evaluation result of the golf ball in FIG. 22.
Figure 36:
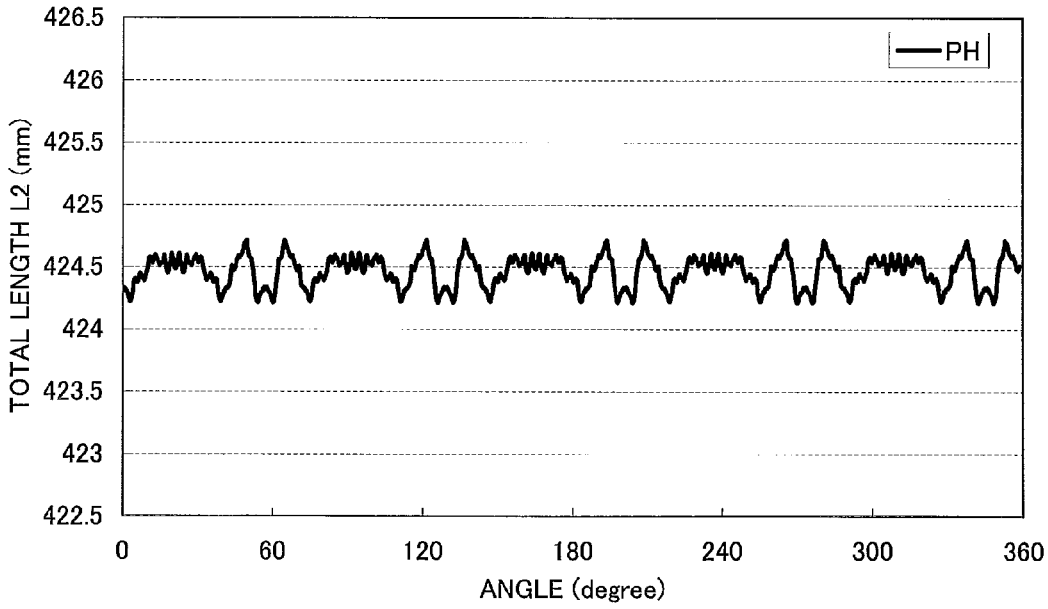
FIG. 36 is a graph showing another evaluation result of the golf ball in FIG. 22.
Figure 37:
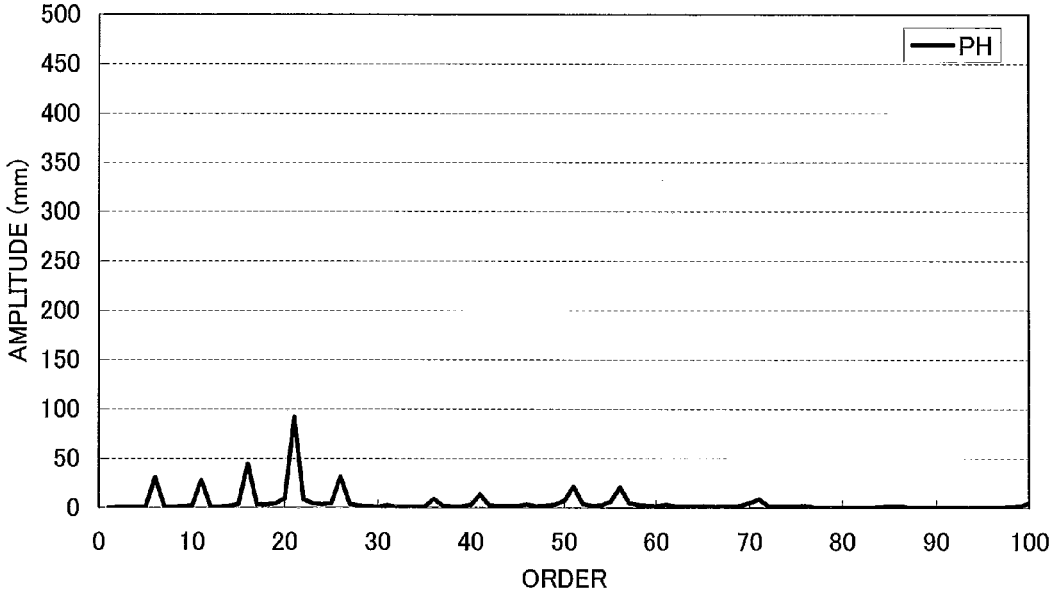
FIG. 37 is a graph showing another evaluation result of the golf ball in FIG. 22.
Figure 38:
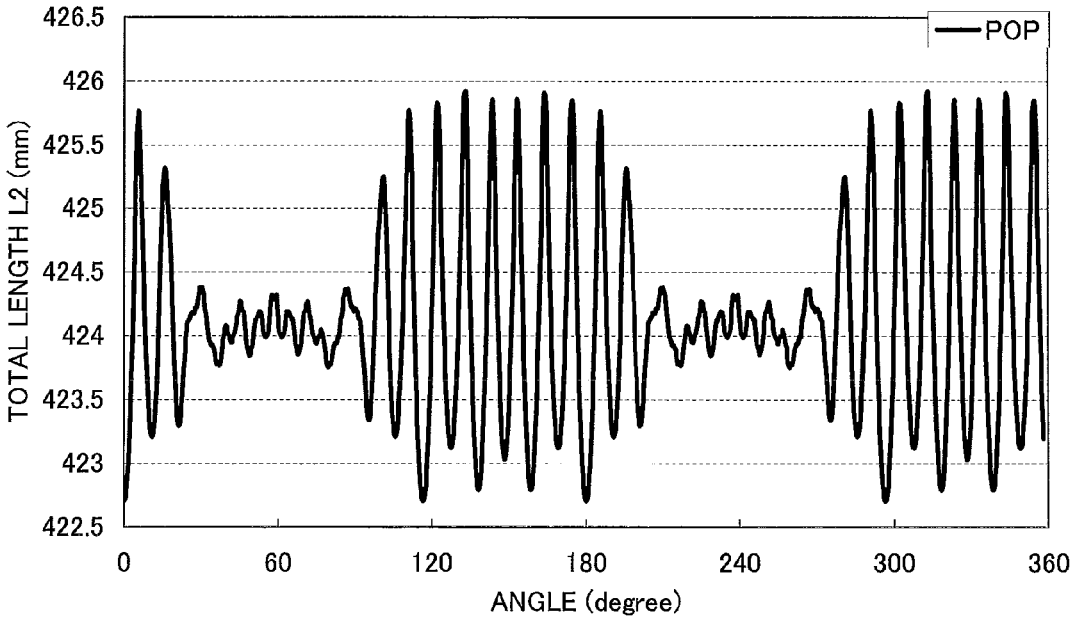
FIG. 38 is a graph showing an evaluation result of the golf ball in FIG. 24.
Figure 39:
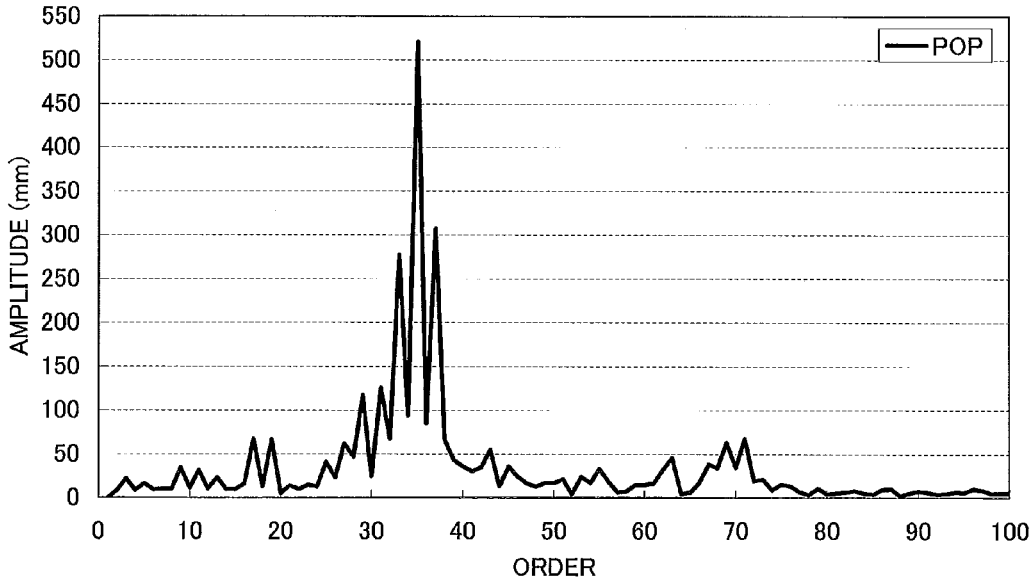
FIG. 39 is a graph showing another evaluation result of the golf ball in FIG. 24.
Figure 40:
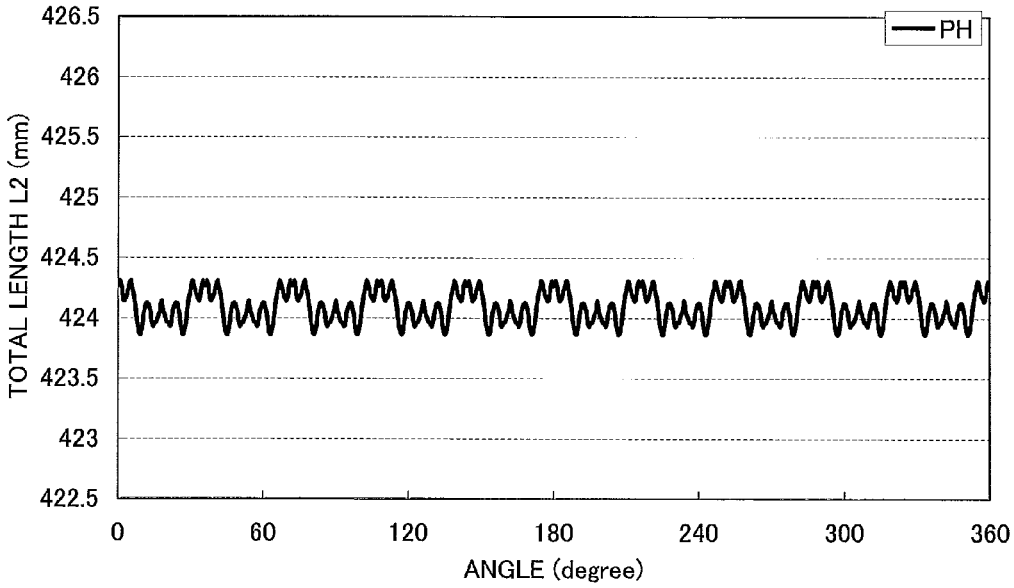
FIG. 40 is a graph showing another evaluation result of the golf ball in FIG. 24.
Figure 41:
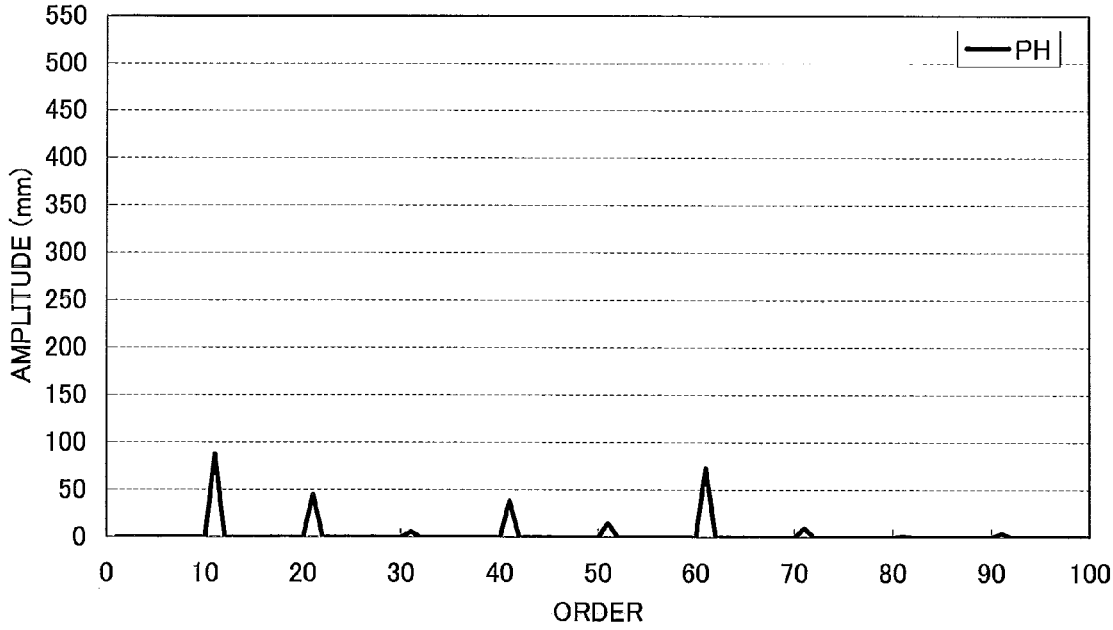
FIG. 41 is a graph showing another evaluation result of the golf ball in FIG. 24.

| Results of Evaluation | | | | | |
|---|---|---|---|---|---|
| | Embodiment 1 | Embodiment 2 | Embodiment 3 | Compara. Example 1 | Compara. Example 2 |
| PH rotation | FIG. 11<br>FIG. 12 | FIG. 26<br>FIG. 27 | FIG. 30<br>FIG. 31 | FIG. 34<br>FIG. 35 | FIG. 38<br>FIG. 39 |
| POP rotation | FIG. 13<br>FIG. 14 | FIG. 28<br>FIG. 29 | FIG. 32<br>FIG. 33 | FIG. 36<br>FIG. 37 | FIG. 40<br>FIG. 41 |
| Pd1 (mm) | 242.5 | 508.2 | 256.5 | 92.1 | 87.6 |
| Pd2 (mm) | 347.8 | 361.1 | 341.5 | 458.1 | 521.0 |
| (Pd1-Pd2) | −105.3 | 147.1 | −85 | 366.0 | 433.4 |
| Fd1 | 31 | 31 | 31 | 21 | 11 |
| Fd2 | 33 | 35 | 33 | 37 | 35 |
| (Fd1-Fd2) | −2 | −4 | −2 | 16 | 24 |

As shown in Table 2, the absolute value of the difference (Pd1−Pd2) and the absolute value of the difference (Fd1−Fd2) are small in the golf balls according to Embodiments 1 to 3. This means that the golf balls according to Embodiments 1 to 3 have excellent aerodynamic symmetry.

The dimple pattern obtained by the method according to the present invention is applicable to a one-piece golf ball, a multi-piece golf ball and a thread-wound golf ball, in addition to a two-piece golf ball. The above description is merely for illustrative examples, and various modifications can be made without departing from the principles of the present invention.

What is claimed is:

1. A designing method for a dimple pattern of a golf ball, the designing method comprising the steps of:

dividing a surface of a phantom sphere of the golf ball into a plurality of units by division lines obtained by projecting edge lines of a regular polyhedron inscribed in the phantom sphere, on the surface of the phantom sphere;

obtaining a base pattern by randomly arranging a plurality of dimples in one unit such that the dimples do not overlap each other; and developing the base pattern over other units such that patterns of two adjacent units are not mirror-symmetrical to each other; wherein a ratio Pn of the number of pairs of adjacent units that are not mirror-symmetrical to each other to the total number of the pairs of the adjacent units is equal to or greater than 80%.

2. The designing method according to claim 1, wherein the regular polyhedron is a regular dodecahedron, each unit is a spherical regular pentagon, and the spherical regular pentagon is obtained by dividing the surface of the phantom sphere by division lines obtained by projecting edge lines of the regular dodecahedron on the surface of the phantom sphere.

3. A golf ball having a dimple pattern made by the method according to claim 1.

4. The golf ball according to claim 3, wherein a ratio of a total area of all dimples to a surface area of a phantom sphere of the golf ball is equal to or greater than 75% but equal to or less than 85%.

5. The golf ball according to claim 3, wherein the golf ball does not have a great circle that does not intersect any dimple.

* * * * *